US010989022B2

(12) United States Patent
Kohn et al.

(10) Patent No.: US 10,989,022 B2
(45) Date of Patent: Apr. 27, 2021

(54) BIG BORE RUNNING TOOL QUICK LOCK ADAPTOR

(71) Applicant: Halliburton Energy Services, Inc., Houston, TX (US)

(72) Inventors: Gary Allen Kohn, Carrollton, TX (US); Carlos Alberto Moreno, Carrollton, TX (US); Odee Paul Daigle, Sachse, TX (US); Ryan Thomas Humphrey, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 293 days.

(21) Appl. No.: 15/779,002

(22) PCT Filed: Mar. 23, 2016

(86) PCT No.: PCT/US2016/023812
§ 371 (c)(1),
(2) Date: May 24, 2018

(87) PCT Pub. No.: WO2017/164869
PCT Pub. Date: Sep. 28, 2017

(65) Prior Publication Data
US 2018/0347323 A1 Dec. 6, 2018

(51) Int. Cl.
*E21B 43/10* (2006.01)
*E21B 23/00* (2006.01)

(52) U.S. Cl.
CPC ..... *E21B 43/10* (2013.01); *E21B 23/00* (2013.01)

(58) Field of Classification Search
CPC ..... E21B 43/10; E21B 23/00
See application file for complete search history.

(56) References Cited

U.S. PATENT DOCUMENTS 4,311,194 A * 1/1982 White ..... E21B 23/06 166/120
4,823,881 A 4/1989 Streich
4,862,966 A 9/1989 Lindsey et al.
4,911,237 A * 3/1990 Melenyzer ..... E21B 17/06 166/208

(Continued)

FOREIGN PATENT DOCUMENTS

EP 1712729 B1 7/2011
WO 2015034489 A1 3/2015

OTHER PUBLICATIONS

European Extended Search Report dated Jul. 19, 2019; European Application No. 16895676.1.

(Continued)

*Primary Examiner* — Giovanna Wright
*Assistant Examiner* — Dany E Akakpo
(74) *Attorney, Agent, or Firm* — McGuireWoods LLP

(57) ABSTRACT

The disclosed embodiments include a coupler assembly and method for conveying a single piece liner hanger body. In one embodiment, the coupler assembly includes a nut, a load transfer sleeve, a locking dog retainer, a garter spring, a locking dog, a collet, an outer collet mandrel, and a collet prop mandrel. As described herein, components of the coupler assembly are assembled and installed within the inner diameter of the single piece liner hanger body for engaging with a liner hanger sub-assembly attached to a miming tool.

20 Claims, 27 Drawing Sheets

(56) References Cited

U.S. PATENT DOCUMENTS

| | | | |
|---|---|---|---|
| 2008/0257560 | A1 | 10/2008 | Brisco et al. |
| 2012/0222868 | A1 | 9/2012 | Hazelip |
| 2012/0298376 | A1 | 11/2012 | Twardowski |
| 2014/0352944 | A1 | 12/2014 | Devarajan et al. |
| 2015/0060086 | A1 | 3/2015 | Saurer et al. |

OTHER PUBLICATIONS

Patent Cooperation Treaty, International Search Report and Written Opinion, PCT Appln. No. PCT/US2016/023812, dated Dec. 21, 2016.

* cited by examiner

BIG BORE RUNNING TOOL QUICK LOCK ADAPTOR

BACKGROUND

The present disclosure relates generally to equipment utilized and operations performed in conjunction with oil and gas exploration and production, and more particularly to a method and coupler assembly for conveying a single piece liner hanger body.

Once a well has been drilled, if it is to become a production well, the well must undergo completion. This principally involves preparing the bottom of the hole to the required specifications, running in the production tubing and its associated down hole tools, as well as perforating and stimulating the well. Typically, the lower completion of the well is set across the productive zone using a liner hanger system, which anchors the lower completion to the production casing string.

The installation of the liner hanger system and these strings presents a variety of challenges. One such challenge is that third party supplied thread connections do not always provide the performance needed to meet the sealing, tensile and compression requirements for the hanger assembly. Third party threads have recently come under close scrutiny during gas testing of liner hangers and have performance issues when gas tight bubble free connections are required.

Accordingly, as will be described herein, one purpose of the disclosed embodiments is to incorporate new and improved geometry such as a one piece hanger body. Additionally, one advantage of the disclosed embodiments is that it offers a means to easily hydro test critical sealing features that previously required expensive test fixtures. Other aspects and advantages of the disclosed embodiments will be apparent from the following description and the appended claims.

BRIEF DESCRIPTION OF THE DRAWINGS

Illustrative embodiments of the present invention are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the claims, and it is understood that other embodiments may be utilized and that logical structural and mechanical changes may be made without departing from the spirit or scope of the disclosed embodiments. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Currently, as part of the well completion process, a big bore running tool is used to set a two piece liner hanger consisting of an upper expandable body and a setting sleeve that is threaded to the bottom of it. The illustrative embodiments modify the current big bore running tool to enable conveying of a big bore liner hanger with a single piece hanger body. As will be described, the disclosed embodiments maintains an assembly method known as "top down" build whereby the assembly begins with the topmost components and parts are added as you move towards the bottom of the running tool.

Figure 1A:
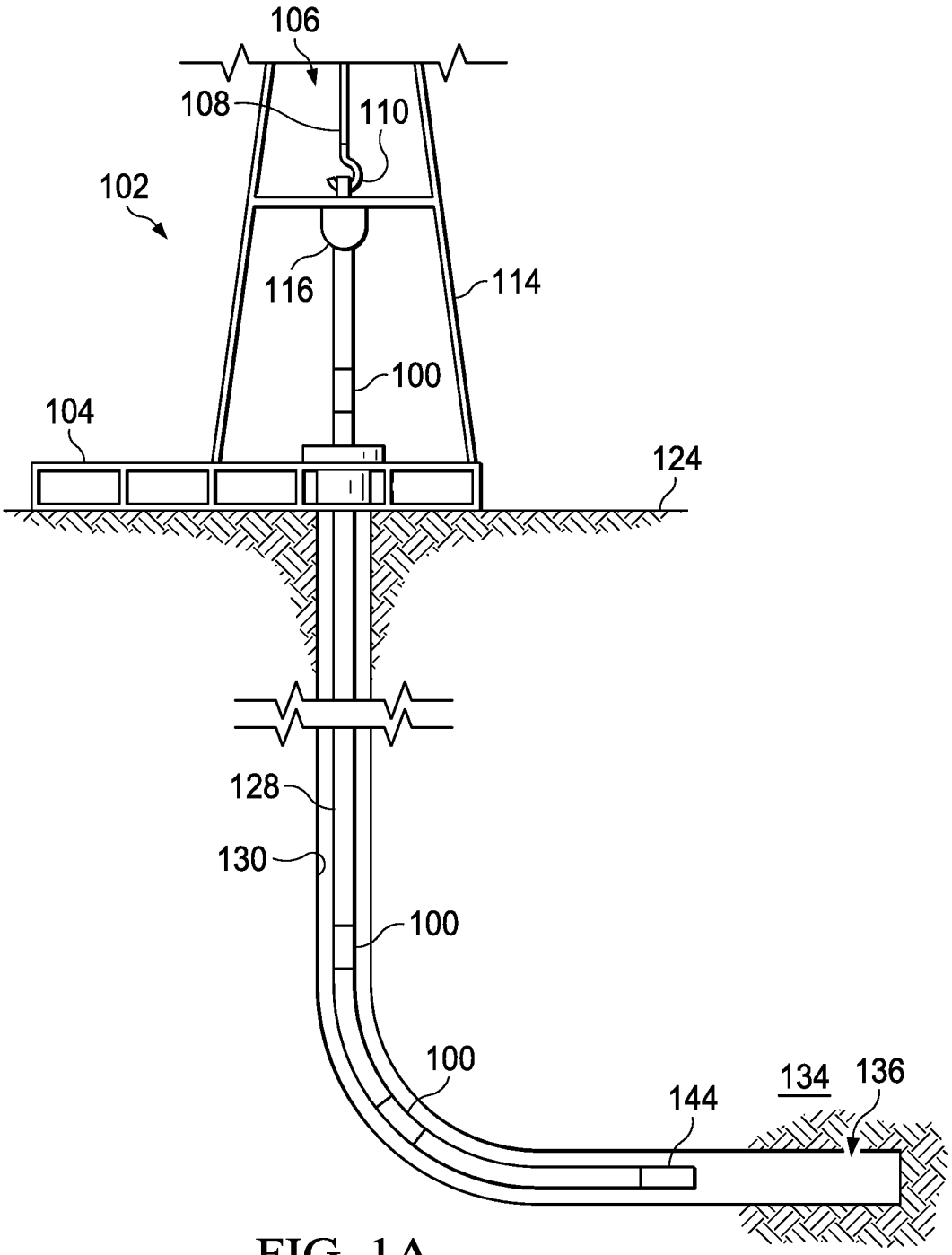
FIG. 1A is a diagram of an on-shore well in which a tool string is deployed according to an illustrative embodiment.

Beginning with FIG. 1A, a schematic view of a rig 104 in which a tool string 128 is deployed that includes a coupler assembly 100 is presented in accordance with an illustrative embodiment. The rig 104 is positioned onshore at a surface 124 of a well 102. The well 102 includes a wellbore 130 that extends from the surface 124 of the well 102 to a subterranean substrate or formation 134. Tool string 128 may deploy running tools used to place or set downhole equipment 144 such as, but not limited to, liner hangers, plugs and packers. For instance, in one embodiment, the coupler assembly 100 may be used to convey or set a liner hanger to a running tool.

Figure 1B:
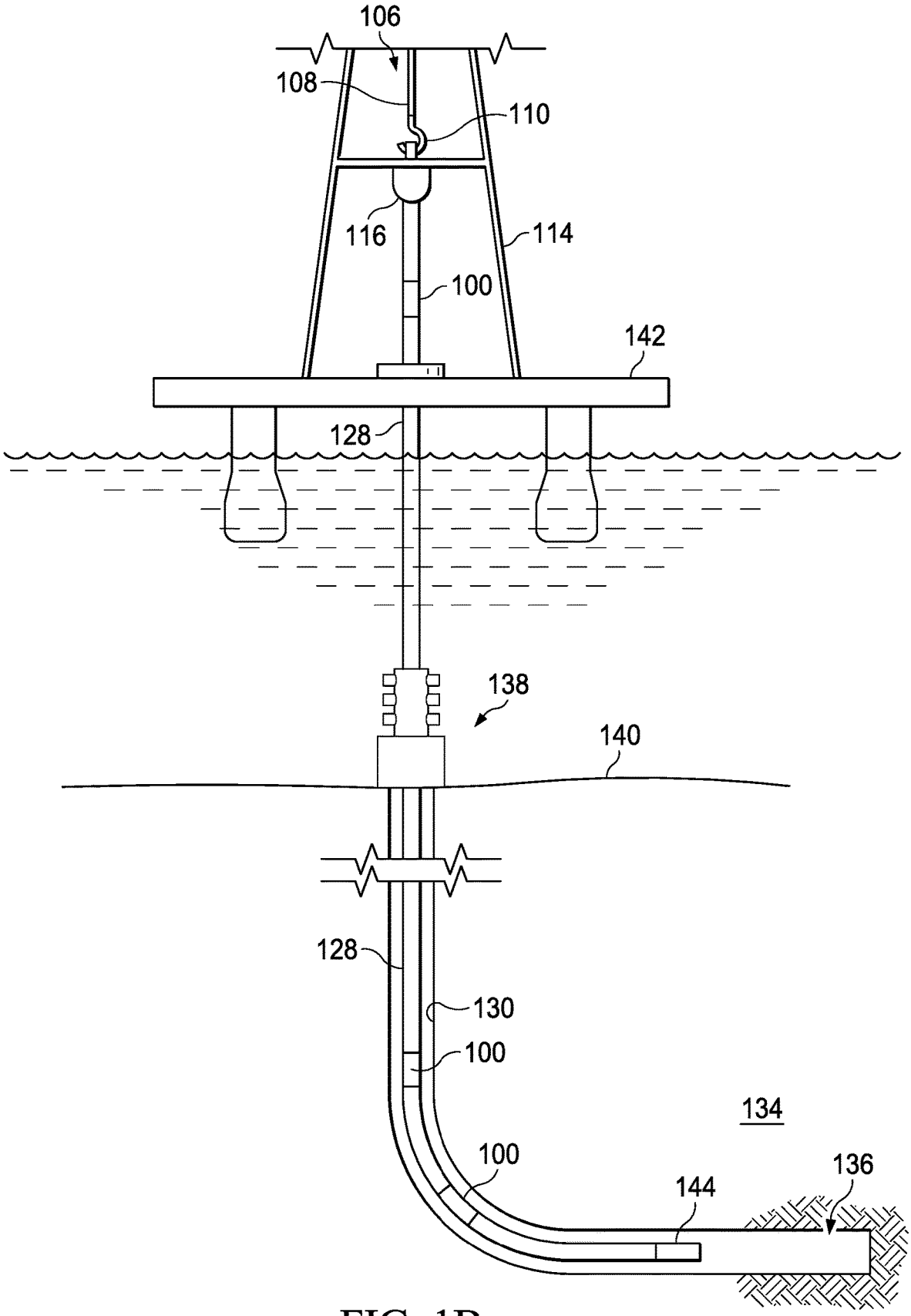
FIG. 1B is a diagram of an off-shore well in which a tool string is deployed according to an illustrative embodiment.

Similarly, FIG. 1B illustrates a schematic view of an offshore platform 142 operating a tool string 128 that includes the coupler assembly 100 according to an illustrative embodiment. The coupler assembly 100 in FIG. 1B may be deployed in a sub-sea well 138 accessed by the offshore platform 142. The offshore platform 142 may be a floating platform or may instead be anchored to a seabed 140.

FIGS. 1A-1B each illustrate possible uses or deployments of the coupler assembly 100, which in either instance may be used in tool string 128 to deploy the downhole equipment 144. In the embodiments illustrated in FIGS. 1A and 1B, the wellbore 130 has been formed by a drilling process in which dirt, rock and other subterranean material has been cut from the formation 134 by a drill bit operated via a drill string to create the wellbore 130. During or after the drilling process, a portion of the wellbore may be cased with a casing (not illustrated in FIGS. 1A and 1B). In other embodiments, the wellbore may be maintained in an open-hole configuration without casing.

The tool string 128 may include sections of tubing, each of which are joined to adjacent tubing by threaded or other connection types, such as coupler assembly 100. The tool string 128 may refer to the collection of pipes, mandrels or tubes as a single component, or alternatively to the individual pipes, mandrels, or tubes that comprise the string. The term tool string is not meant to be limiting in nature and may include a running tool or any other type of tool string used to deploy the downhole equipment 144 in the wellbore. In some embodiments, the tool string 128 may include a passage disposed longitudinally in the tool string 128 that is capable of allowing fluid communication between the surface 124 of the well 102 and a downhole location 136. It is noted that the coupler assembly 100 described herein may be used to couple tubing segments in any suitable tool string, including, for example, a running tool for deploying a liner hanger.

The lowering of the tool string 128 may be accomplished by a lift assembly 106 associated with a derrick 114 positioned on or adjacent to the rig 104 or offshore platform 142. The lift assembly 106 may include a hook 110, a cable 108, a traveling block (not shown), and a hoist (not shown) that cooperatively work together to lift or lower a swivel 116 that is coupled an upper end of the tool string 128. The tool string 128 may be raised or lowered as needed to add additional sections of tubing to the tool string 128 to position the distal end of the tool string 128 at the downhole location 136 in the wellbore 130.

Figure 2:
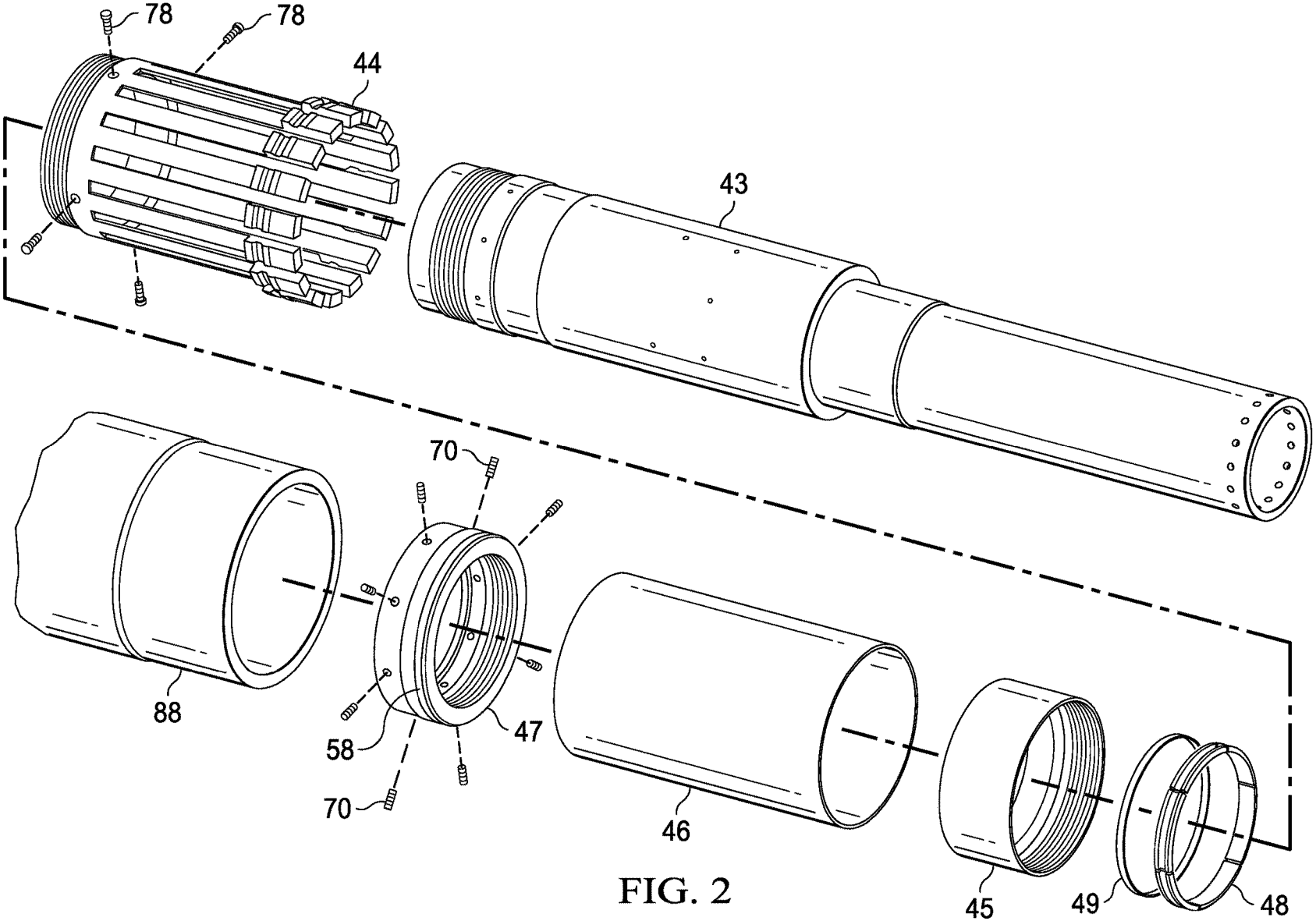
FIG. 2 is a diagram of the inner sub-assembly components of a coupler assembly for conveying a liner hanger to a running tool according to an illustrative embodiment.

Referring now to the detail description of the coupler assembly 100, FIG. 2 illustrates the inner sub-assembly components of the coupler assembly 100 in accordance with one embodiment. In this illustrative embodiment, the coupler assembly 100 is used for conveying a liner hanger 88 to a running tool 90 (illustrated in FIG. 18). The inner sub-assembly components of the coupler assembly 100 include a nut 47, a load transfer sleeve 46, a locking dog retainer 45, a garter spring 49, a locking dog 48, a collet 44, and an outer collet mandrel 43. As will be further described, once the inner sub-assembly of the coupler assembly 100 is assembled, the assembled inner sub-assembly of the coupler assembly 100 is inserted into the liner hanger 88.

Figure 3:
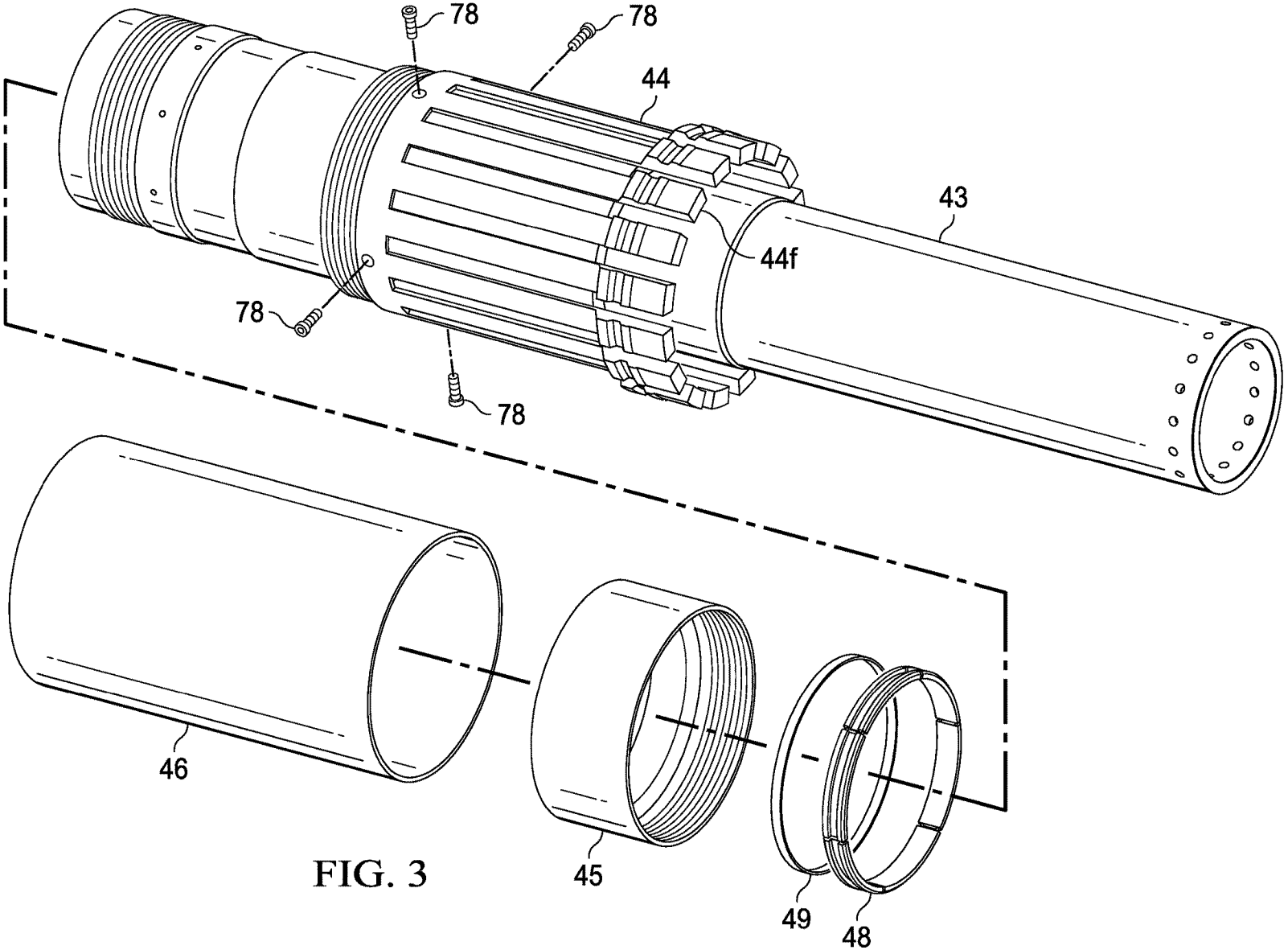
FIGS. 3-14 are diagrams illustrating a method of assembling the inner sub-assembly components of the coupler assembly according to an illustrative embodiment.
Figure 4:
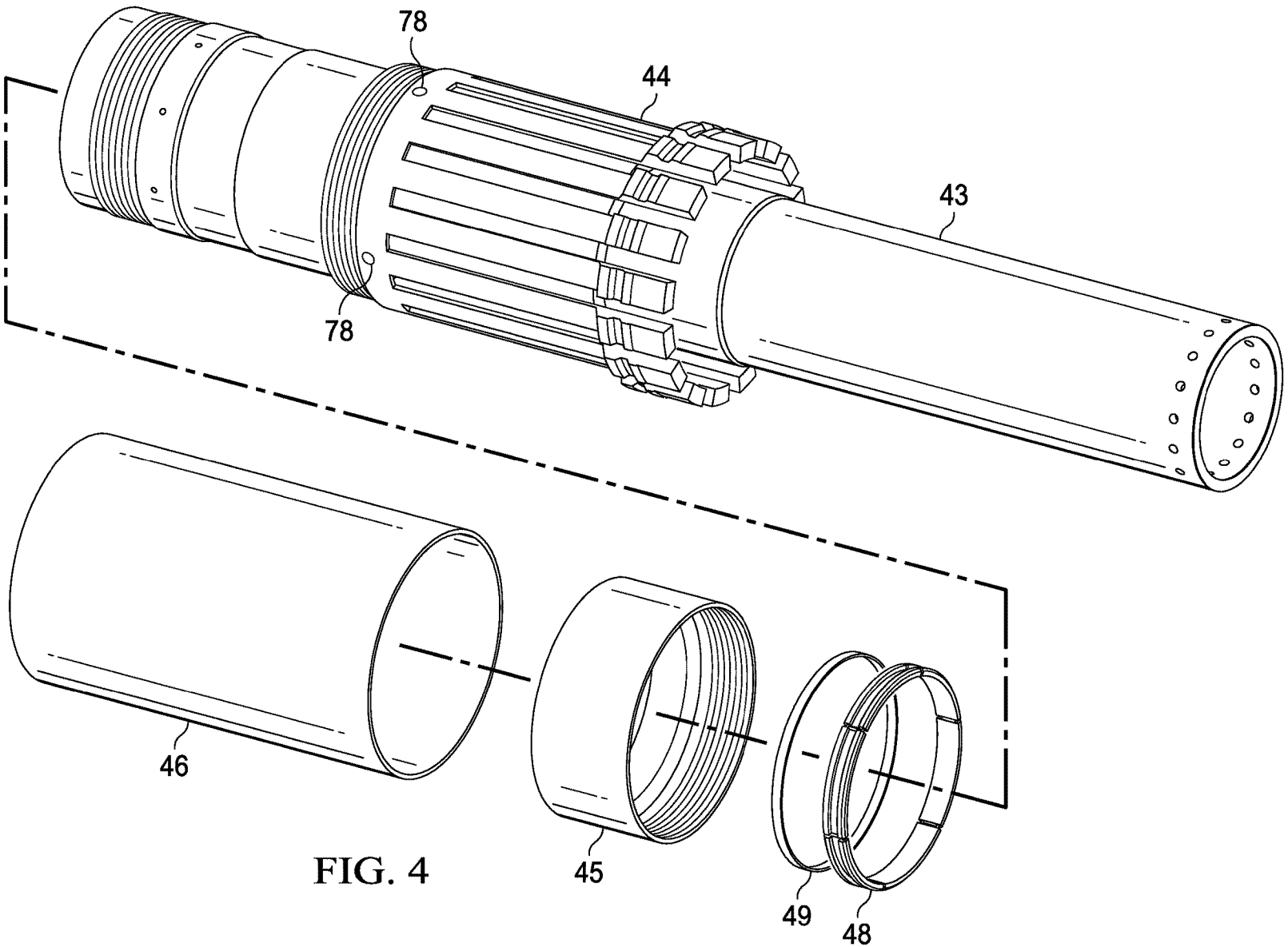

FIGS. 3-15 illustrate a method of assembling the inner sub-assembly components of the coupler assembly 100 according to an illustrative embodiment. The assembly method starts with FIG. 3 where the collet 44 is positioned over the outer collet mandrel 43. The collet 44 comprises a set of collet fingers 44*f* on one end and a threaded outer diameter on the other end. A set of apertures on the collet 44 is aligned with holes on the outer collet mandrel 43. In one embodiment, the holes on the outer collet mandrel 43 is threaded to enable a set of threaded screws 78 to be received through the set of apertures on the collet 44 and into the holes on the outer collet mandrel 43 for coupling the collet 44 to the outer collet mandrel 43 as illustrated in FIG. 4.

Figure 5:
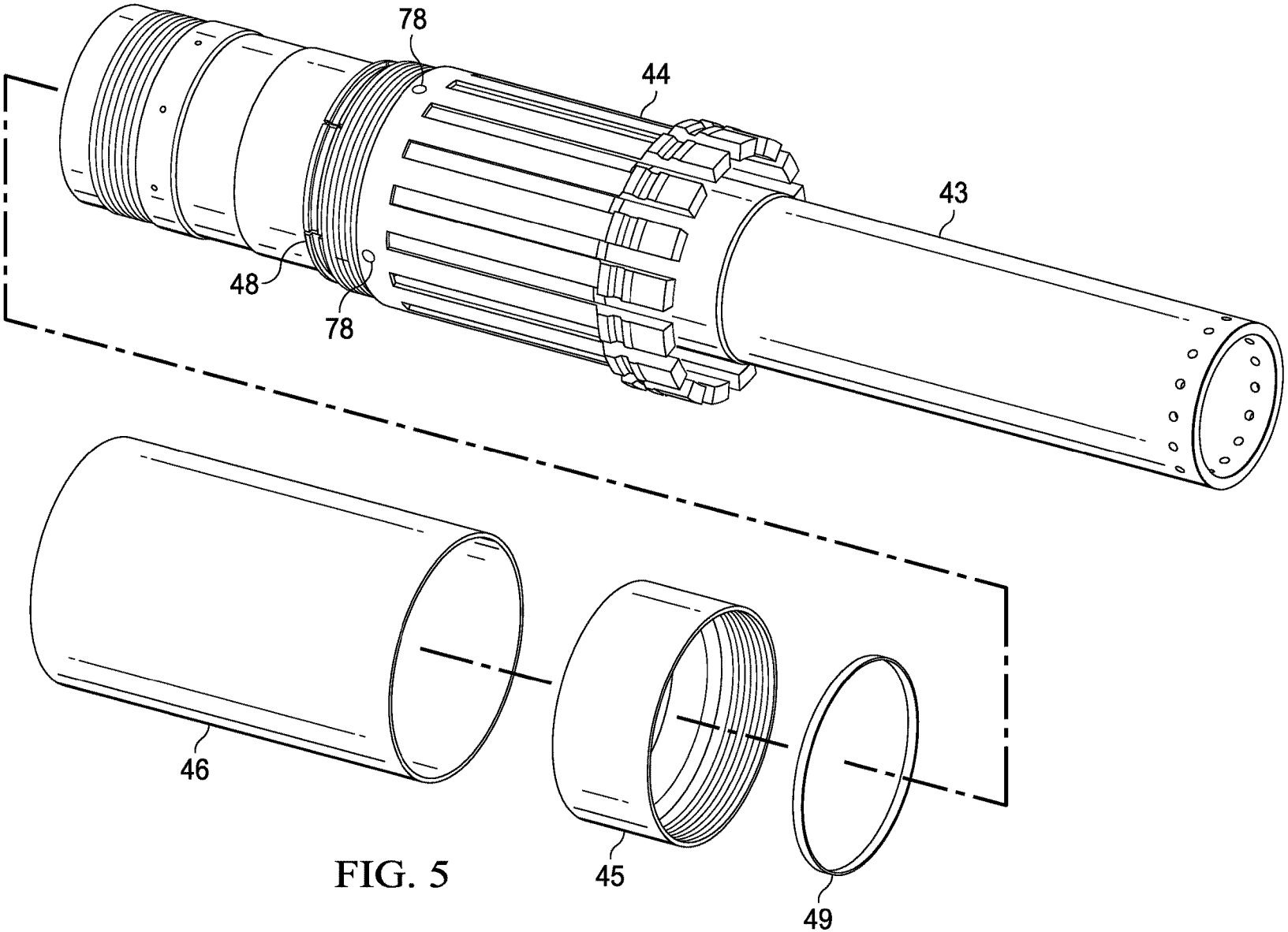
Figure 6:
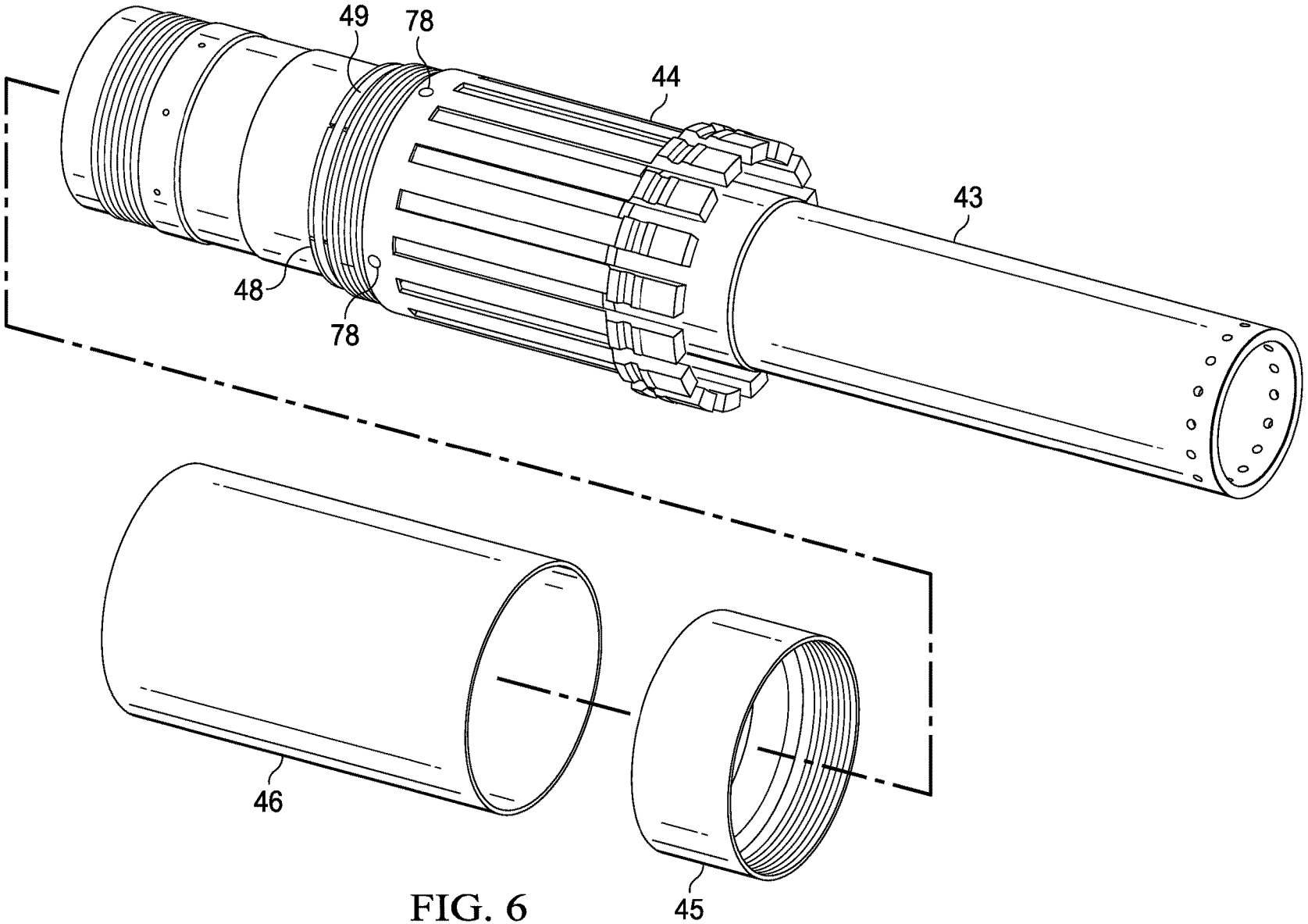
Figure 7:
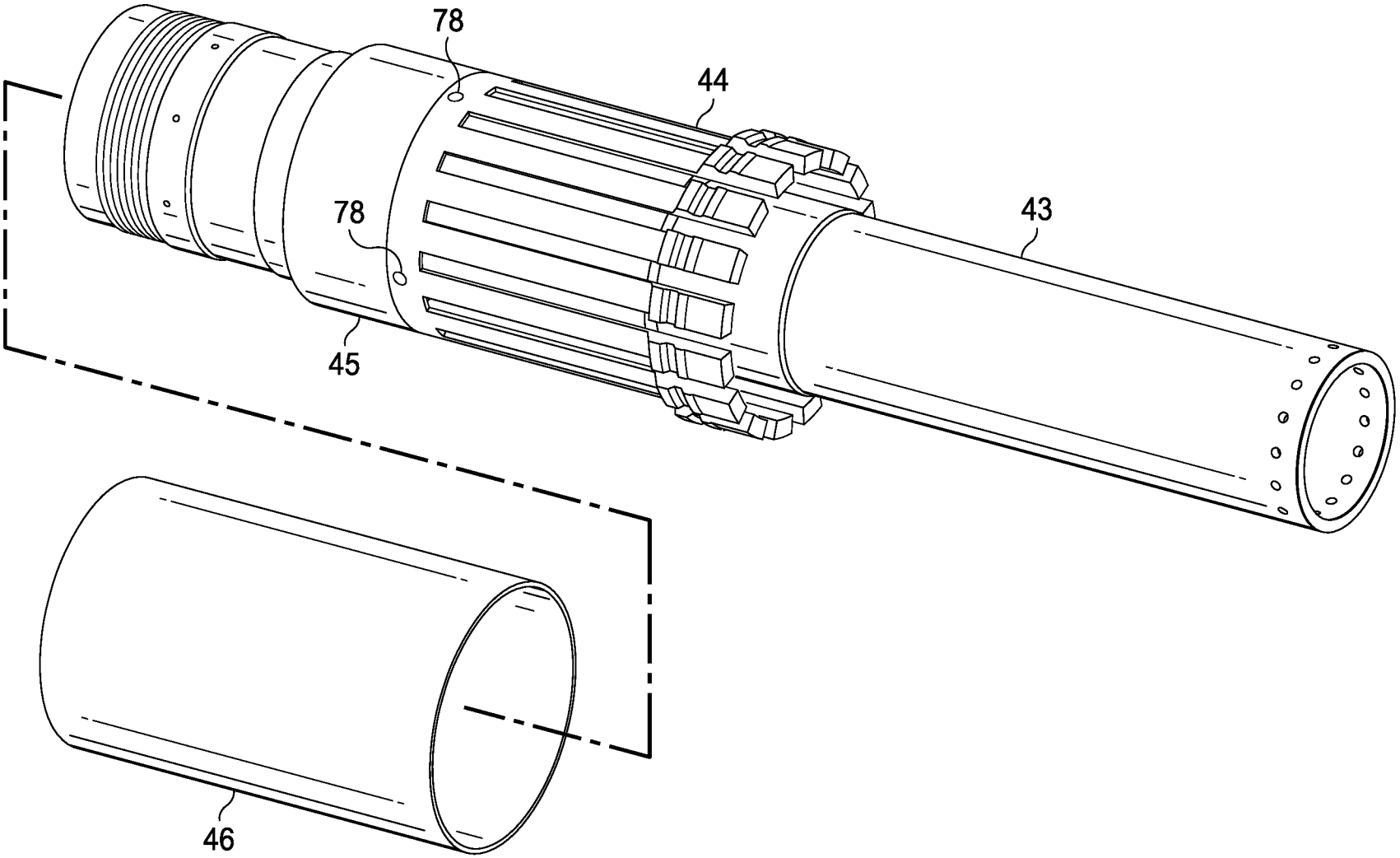
Figure 8:
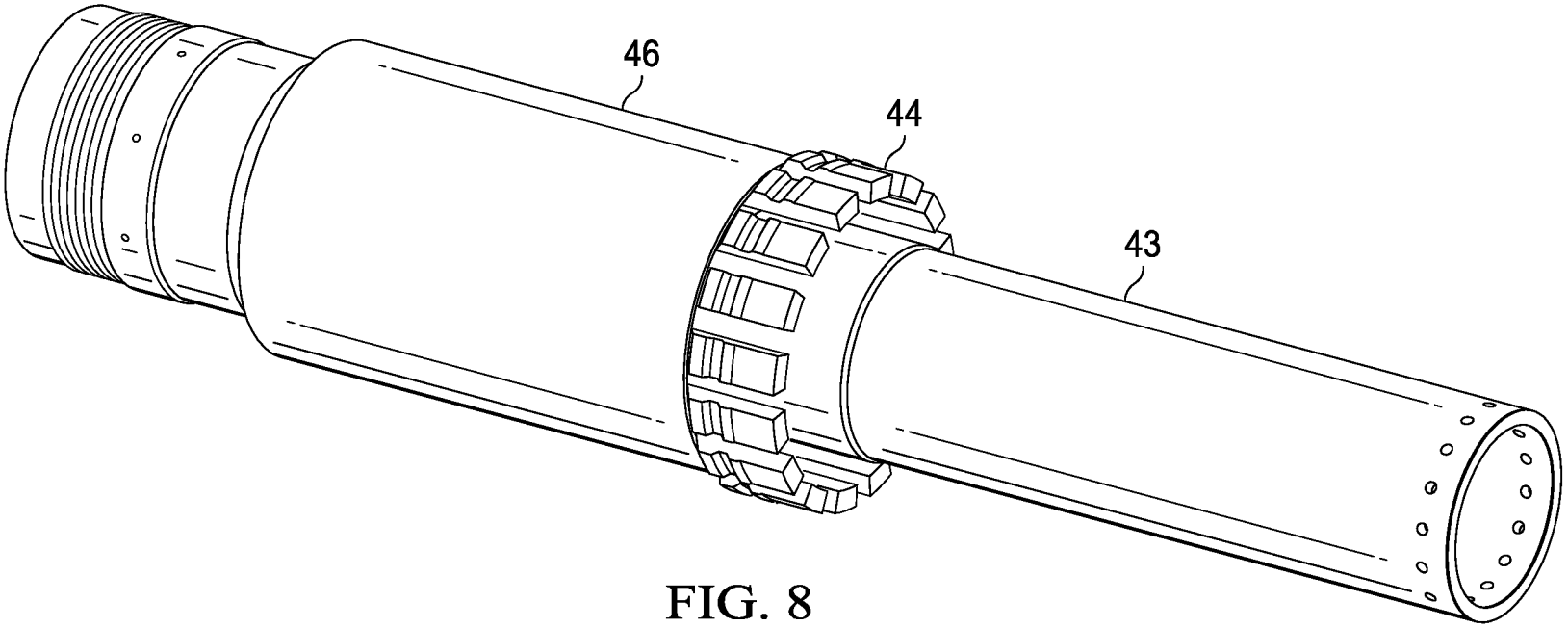

Next, the locking dog 48 is positioned next to the upper end of the collet 44 as shown in FIG. 5. The garter spring 49 is installed onto the locking dog 48 to keep it in place as illustrated in FIG. 6. The locking dog retainer 45 is then threaded to the collet 44 over the locking dog 48 and the garter spring 49 as shown in FIG. 7. The load transfer sleeve 46 is then installed over the locking dog retainer 45 and the collet 44. The load transfer sleeve 46 abuts a raised edge of the set of collet fingers 44*f* of the collet 44 as shown in FIG. 8.

Figure 9:
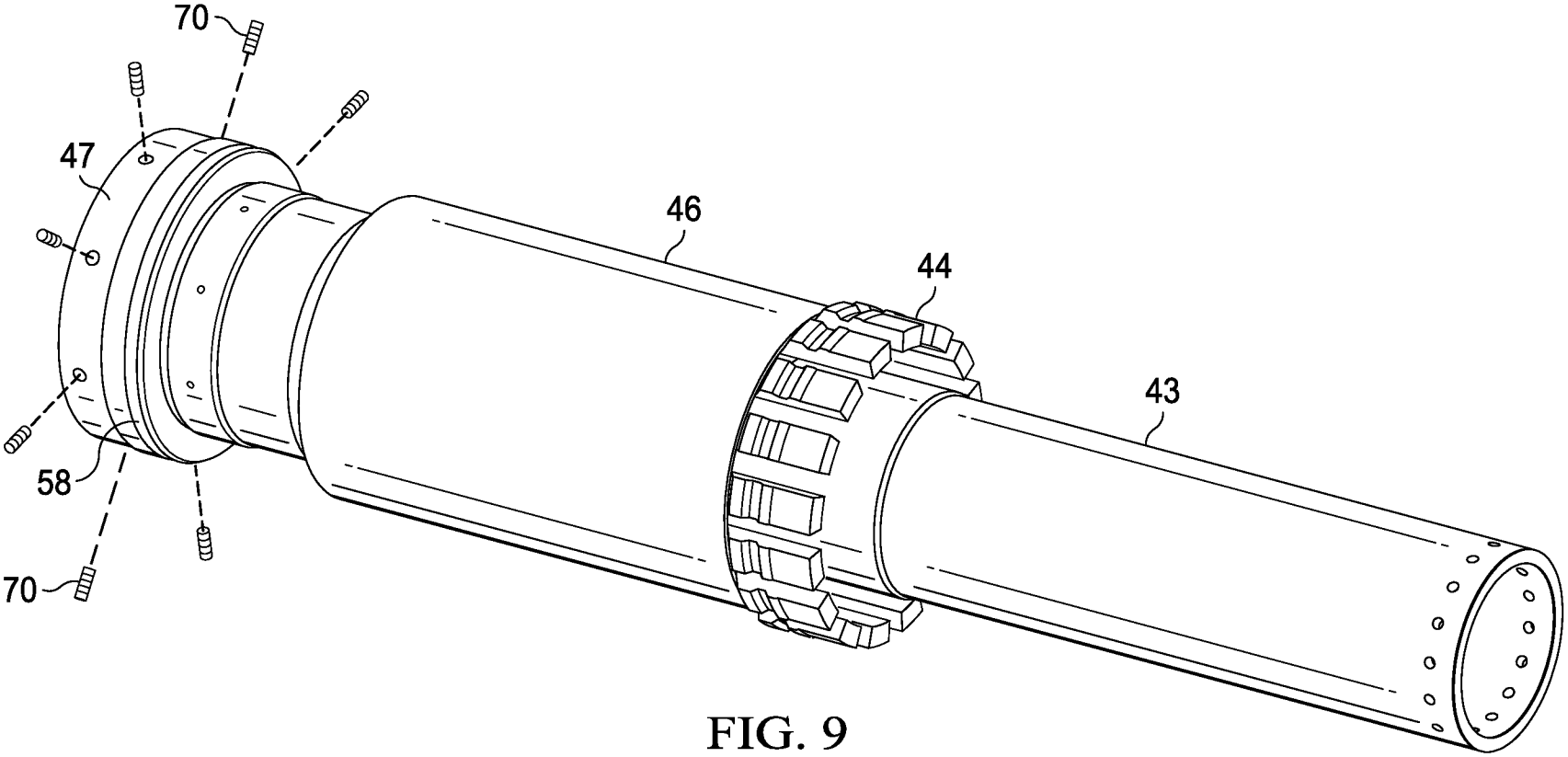
Figure 10:
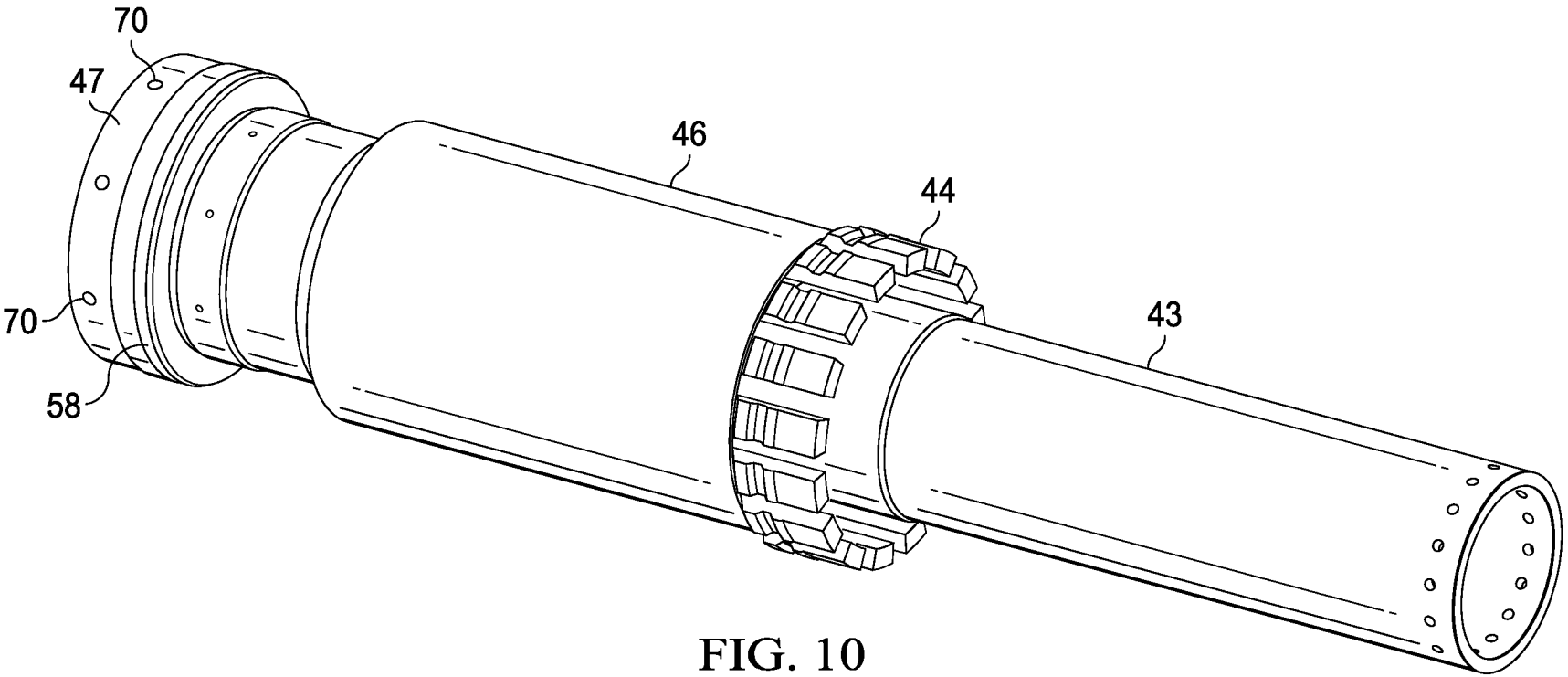
Figure 13:
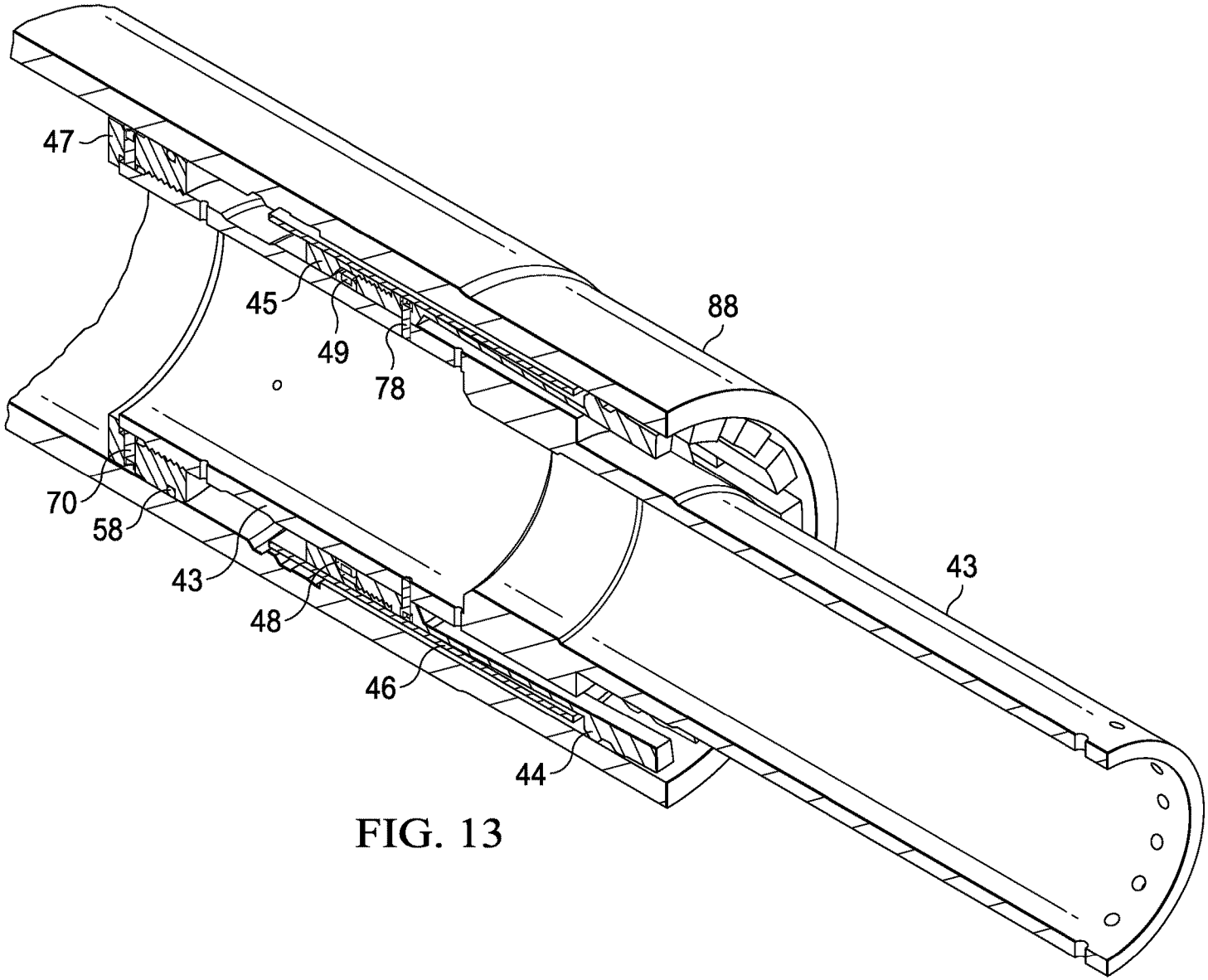
Figure 14:
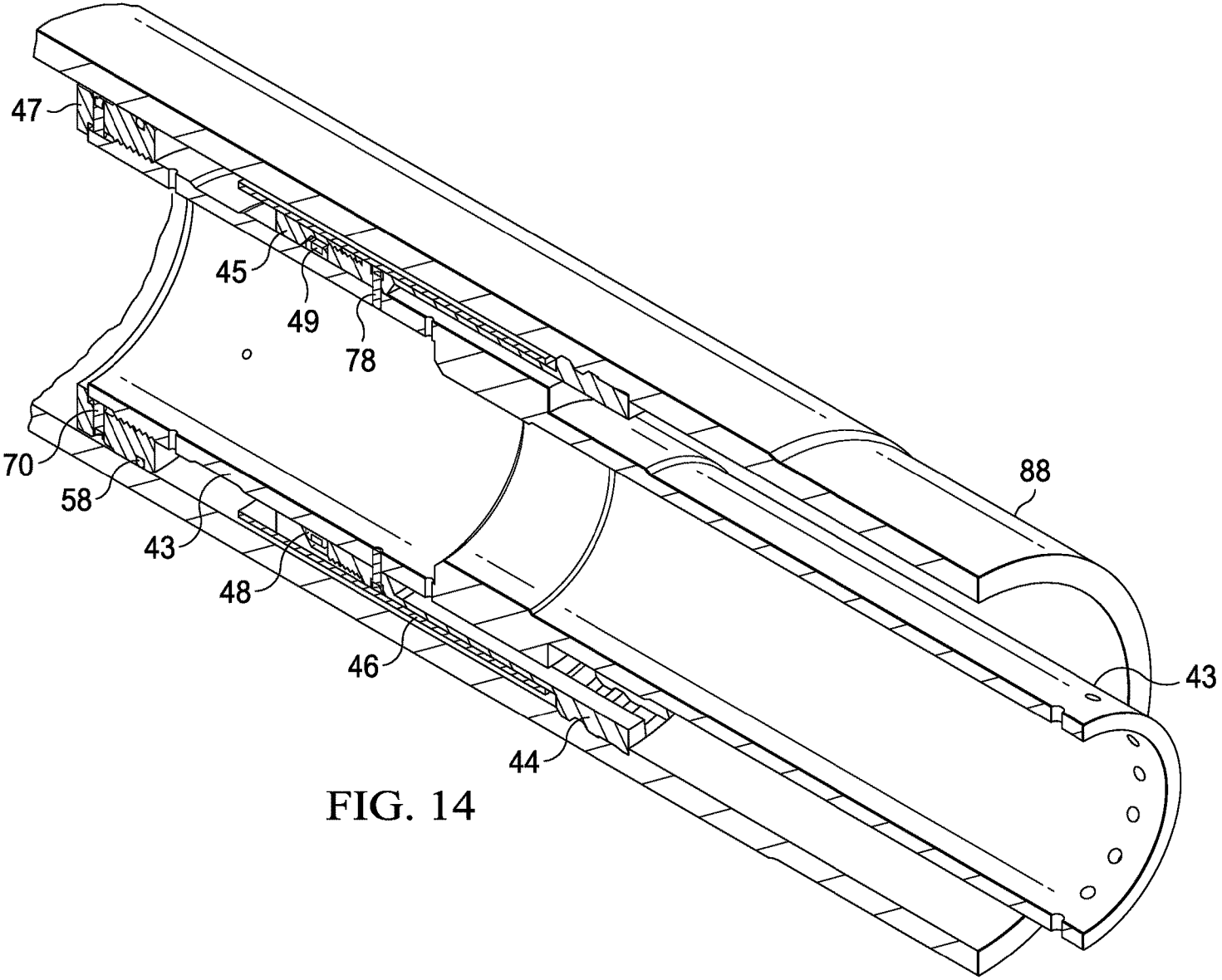

The nut 47 is then threaded onto the top end of the outer collet mandrel 43 as shown in FIG. 9. In one embodiment, an O-ring 58 is placed in the outer diameter of nut 47. The O-ring 58 is compressed during assembly between the nut 47 and the inside of liner hanger 88 creating a seal at the interface as shown in FIG. 13-14. A set of screws 70 is installed to secure the nut 47 to the outer collet mandrel 43 as shown in FIG. 10 to complete the assembly process of the inner sub-assembly components of the coupler assembly 100.

Figure 11:
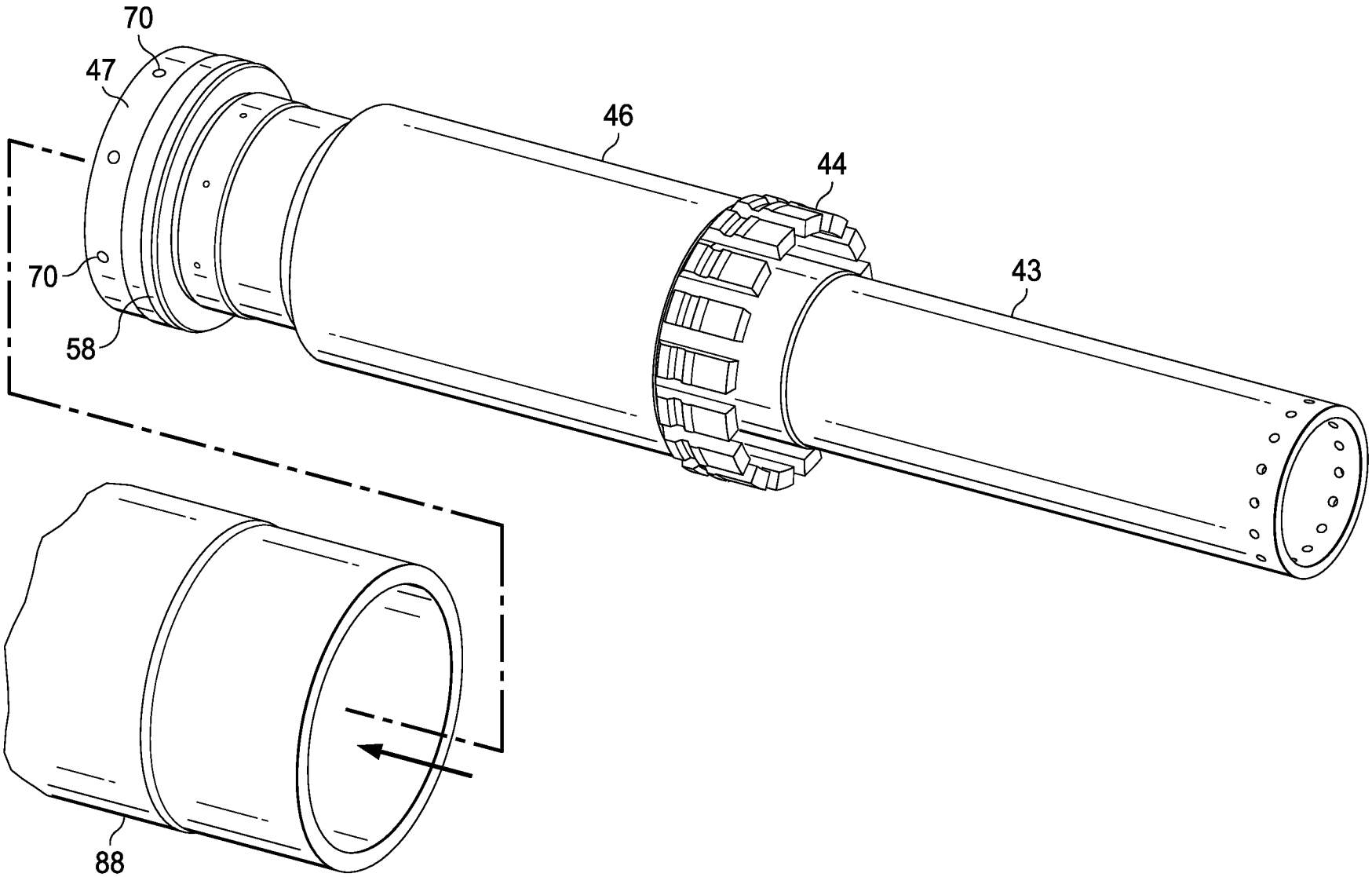
Figure 12:
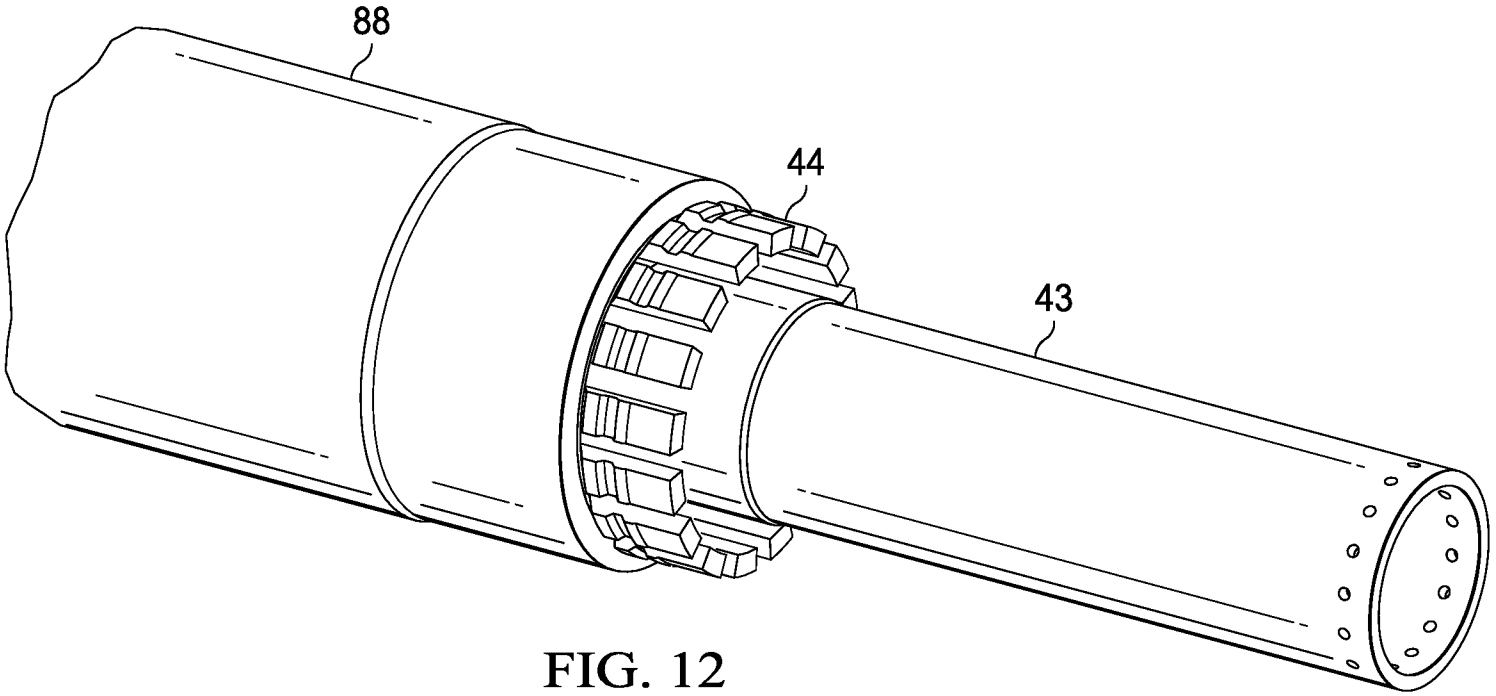

The assembled inner sub-assembly of the coupler assembly 100 is then inserted into the bottom end of the liner hanger 88 as indicated in FIG. 11. As the coupler assembly 100 is inserted into the bottom end of the liner hanger 88, the set of collet fingers 44*f* of the collet 44 will collapse down to allow the collet 44 to enter the bottom end of the liner hanger 88 as illustrated in FIGS. 12 and 13.

FIG. 13 illustrates a cross section of the assembled inner sub-assembly of the coupler assembly 100 as it is being inserted into the bottom end of the liner hanger 88. As shown, the set of collet fingers 44*f* of the collet 44 is depressed as the collet 44 is fully inserted into the bottom end of the liner hanger 88. In one embodiment, the outer collet mandrel 43 is long enough to allow the assembled inner sub-assembly of the coupler assembly 100 to be manipulated by hand allowing the load bearing collet fingers 44*f* to engage mating features near the bottom of the liner hanger 88 machined into the inner diameter of the liner hanger 88 as illustrated in FIG. 14. In some embodiments, a circular pattern of radially drilled holes at the bottom end of the outer collet mandrel 43 can accept a steel bar that aids the application of torque when hand fitting the load bearing features of the collet 44 (i.e., the collet fingers 440 into the mating features in the liner hanger 88. In certain embodiments, the outside diameter features at the lower end of the outer collet mandrel 43 are much smaller than the inside diameter of the liner hanger 88 and allows for visual inspection to determine if the collet fingers 44*f* have properly deployed into the mating features in the liner hanger 88.

Figure 15:
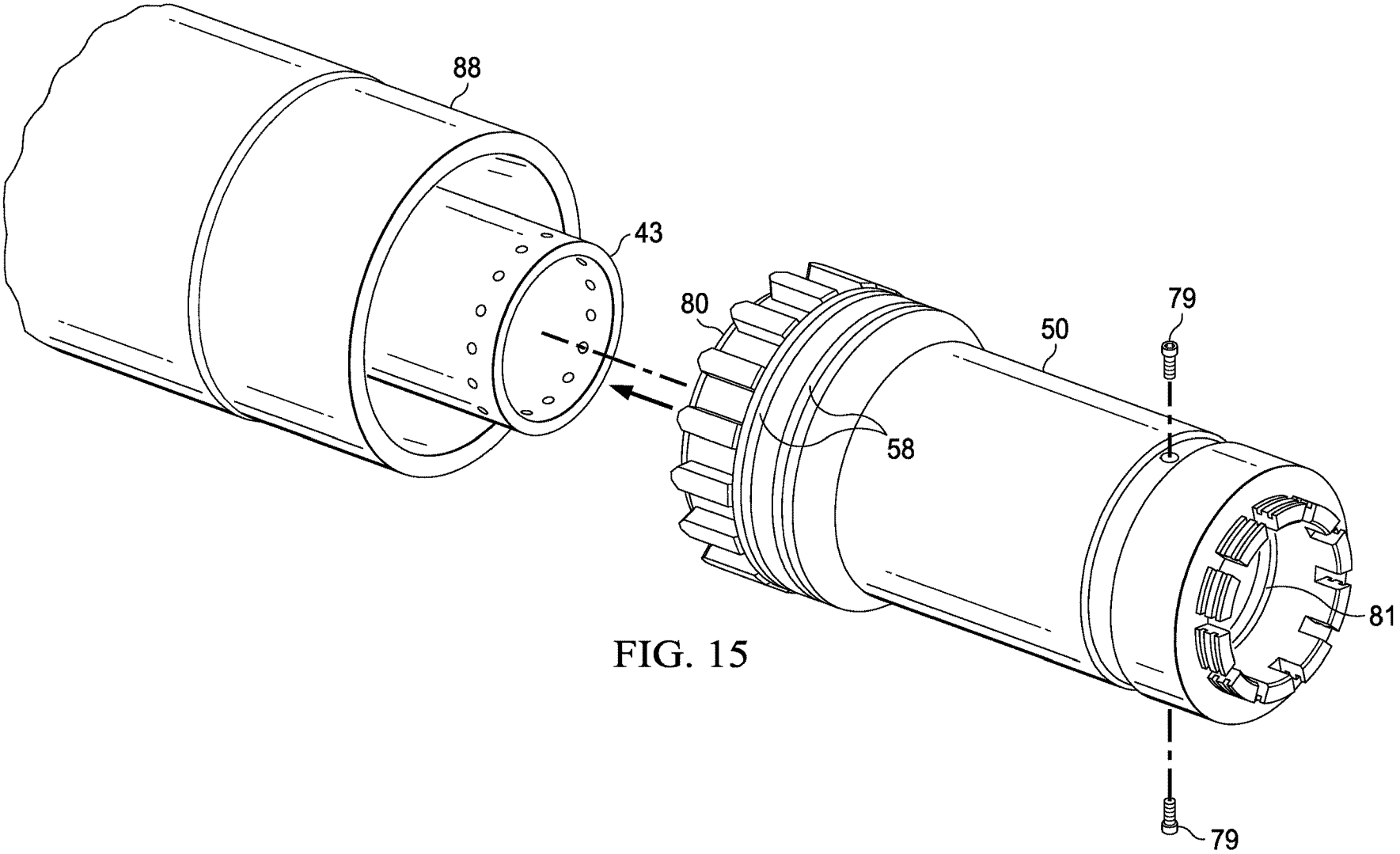
FIGS. 15-24 are diagrams illustrating a method of assembling the outer sub-assembly components of the coupler assembly according to an illustrative embodiment.

Once the collet fingers 44*f* have properly deployed into the mating features in the liner hanger 88, a collet prop mandrel 50 is inserted into the bottom end of the liner hanger 88 as indicated in FIG. 15. At its top end, the collet prop mandrel 50 includes a section of ridges for mating with the collet fingers 44*f* in the inner sub-assembly of the coupler assembly 100. In the depicted embodiment, the collet prop mandrel 50 also includes an O-ring 80 located in the inner diameter at the top end, two O-rings 58 around its outer diameter following the ridged section, and an O-ring 81 located in the inner diameter at the bottom end of the collet prop mandrel 50.

Figure 16:
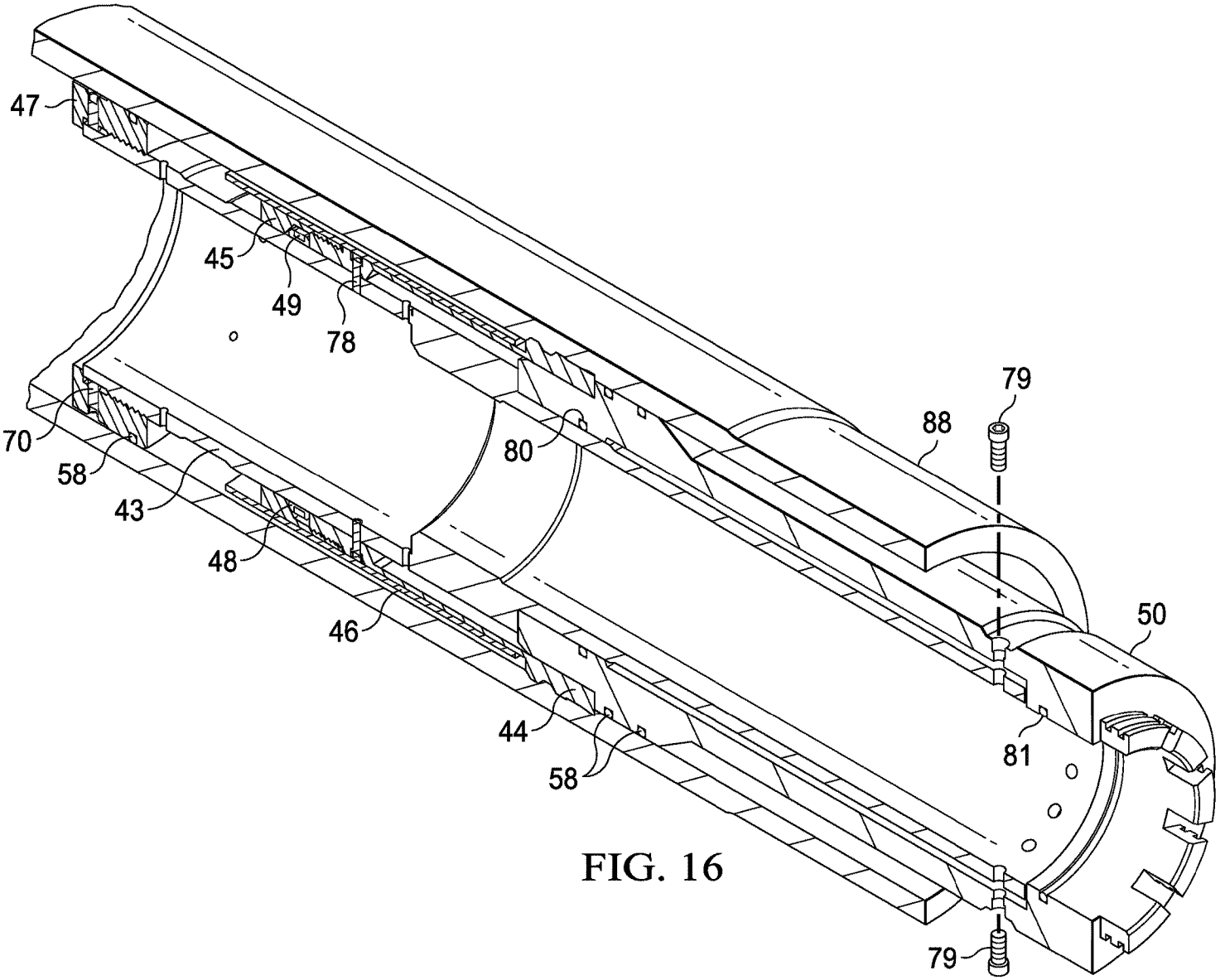

The collet prop mandrel 50 is axially disposed until the collet 44 is propped and the collet prop mandrel 50 shoulders against the outer collet mandrel 43 with a portion of the collet prop mandrel 50 extending out from the bottom of the liner hanger 88 as illustrated in the cross section shown in FIG. 16. O-ring 80 is compressed during assembly between the collet prop mandrel 50 and the outside of outer collet mandrel 43 creating a seal at the interface as shown in FIG. 16. Two O-rings 58 are compressed during assembly between the collet prop mandrel 50 and the inside of liner hanger 88 creating a seal at the interface as shown in FIG. 16.

Figure 17:
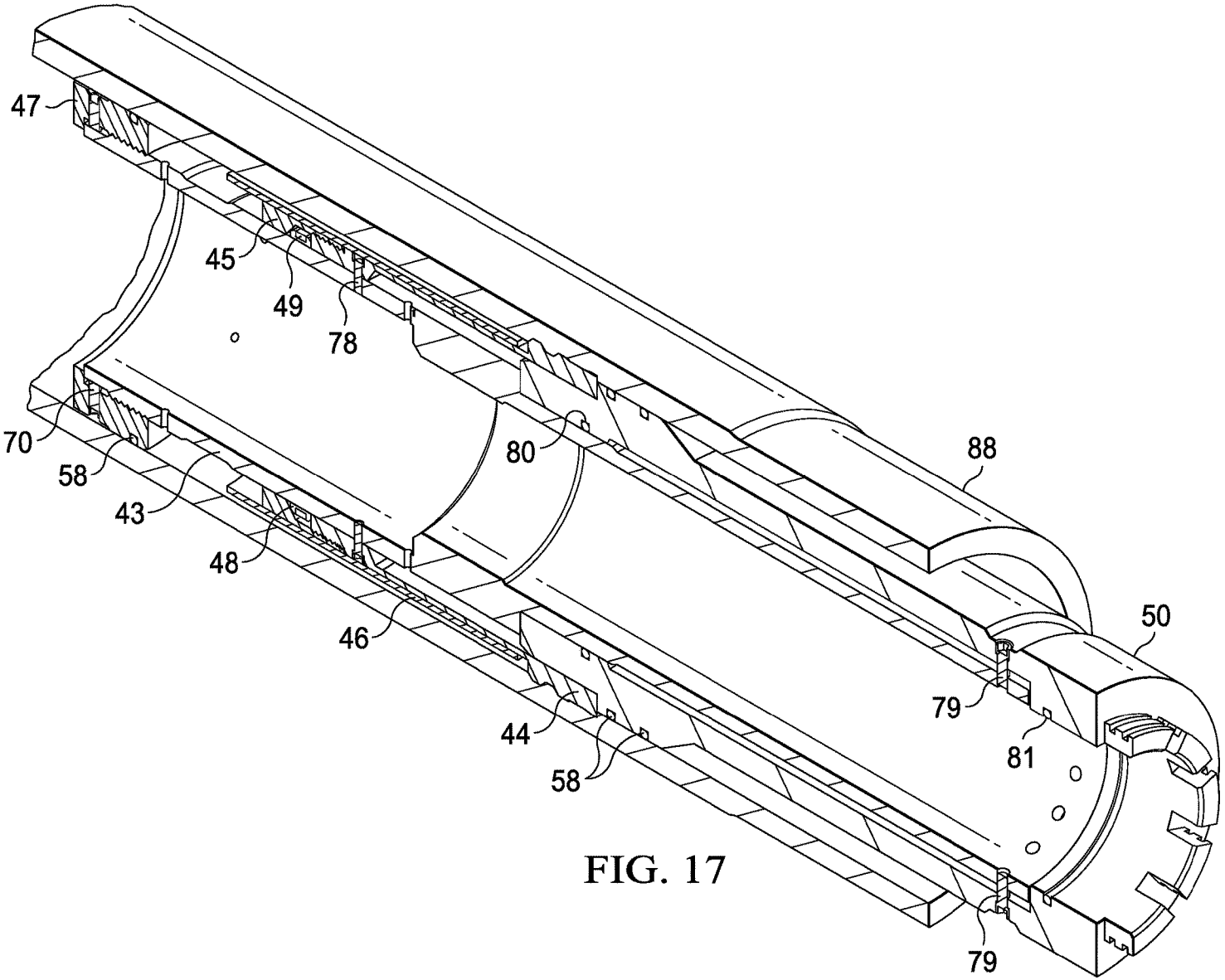

Two threaded hollow plugs 79 is then inserted into test ports in the collet prop mandrel 50 that are aligned with apertures in the outer collet mandrel 43 for securing the collet prop mandrel 50 to the inner sub-assembly of the coupler assembly 100 to complete the liner hanger coupler assembly 100 as illustrated in FIG. 17.

Figure 18:
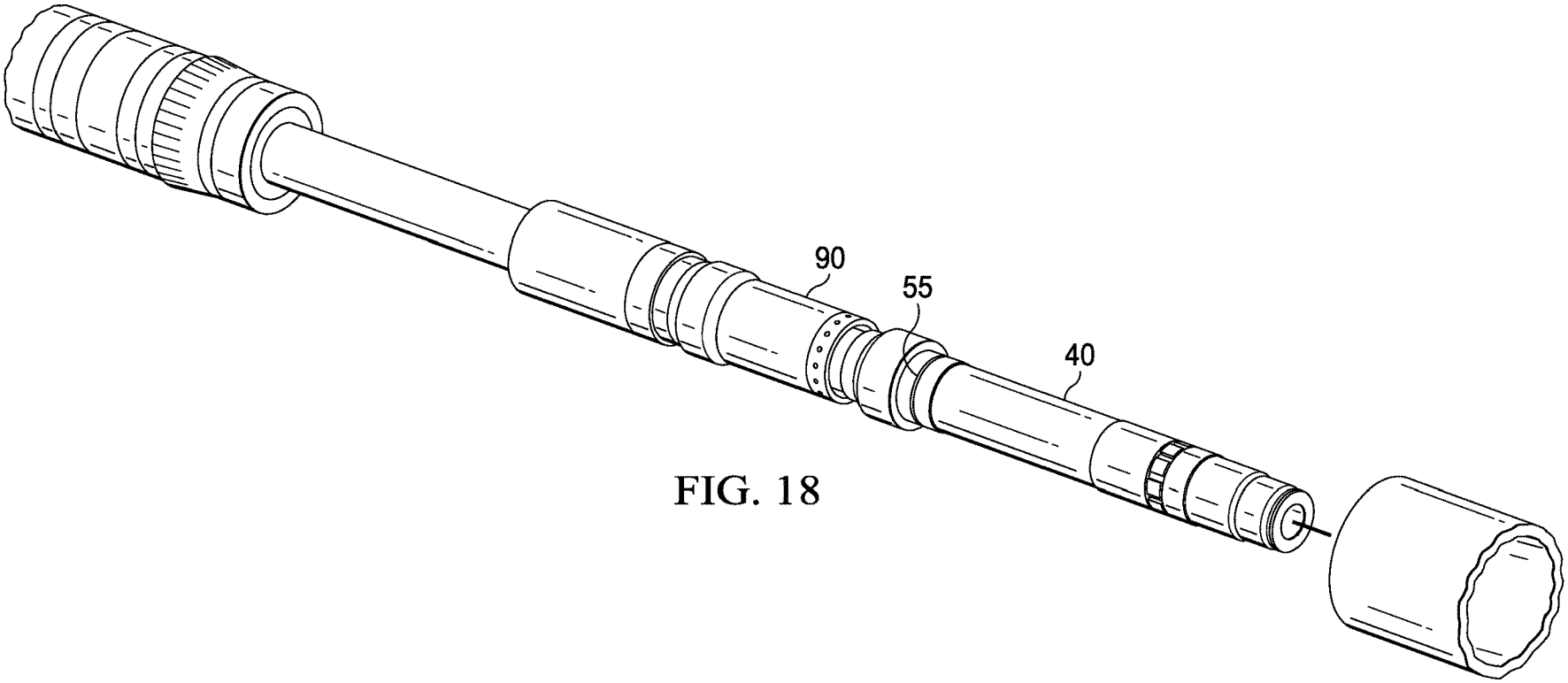
Figure 19:
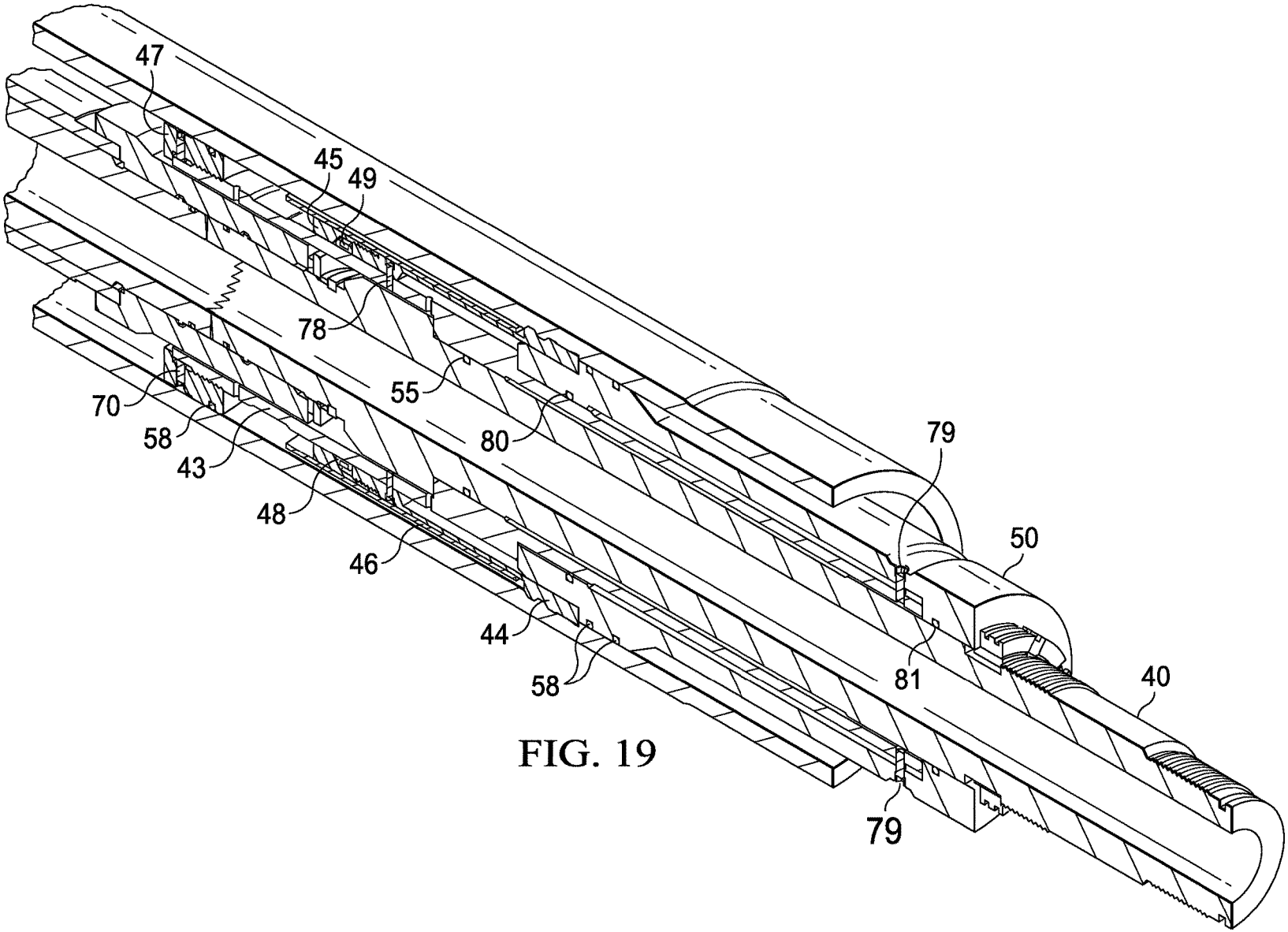

The new two piece coupler assembly 100 is designed to work as a unitized component axially disposed between the top face of the nut 47 and a shoulder on the locking dog retainer 45 in like fashion with existing big bore running tool features. For instance, FIG. 18 illustrates an existing big bore running tool 90 with a liner hanger sub-assembly 40 attached onto the bottom of the running tool 90. In the depicted embodiment, the liner hanger sub-assembly 40 also includes an O-ring 55 located on the outer diameter at the top end. Using the running tool 90, the liner hanger sub-assembly 40 is inserted into the top end of the liner hanger 88. The liner hanger sub-assembly 40 is inserted until it is completely engaged with the outer collet mandrel 43 that was previously inserted into the bottom end of the liner hanger 88. A portion of the liner hanger sub-assembly 40 extends beyond the bottom end of the collet prop mandrel 50 as indicated in FIG. 19. O-ring 55 is compressed during assembly between the liner hanger sub-assembly 40 and the inside of outer collet mandrel 43 creating a seal at the interface as shown in FIG. 19. O-ring 81 is compressed during assembly between the liner hanger sub-assembly 40 and the inside of collet prop mandrel 50 creating a seal at the interface as shown in FIG. 19.

Figure 20:
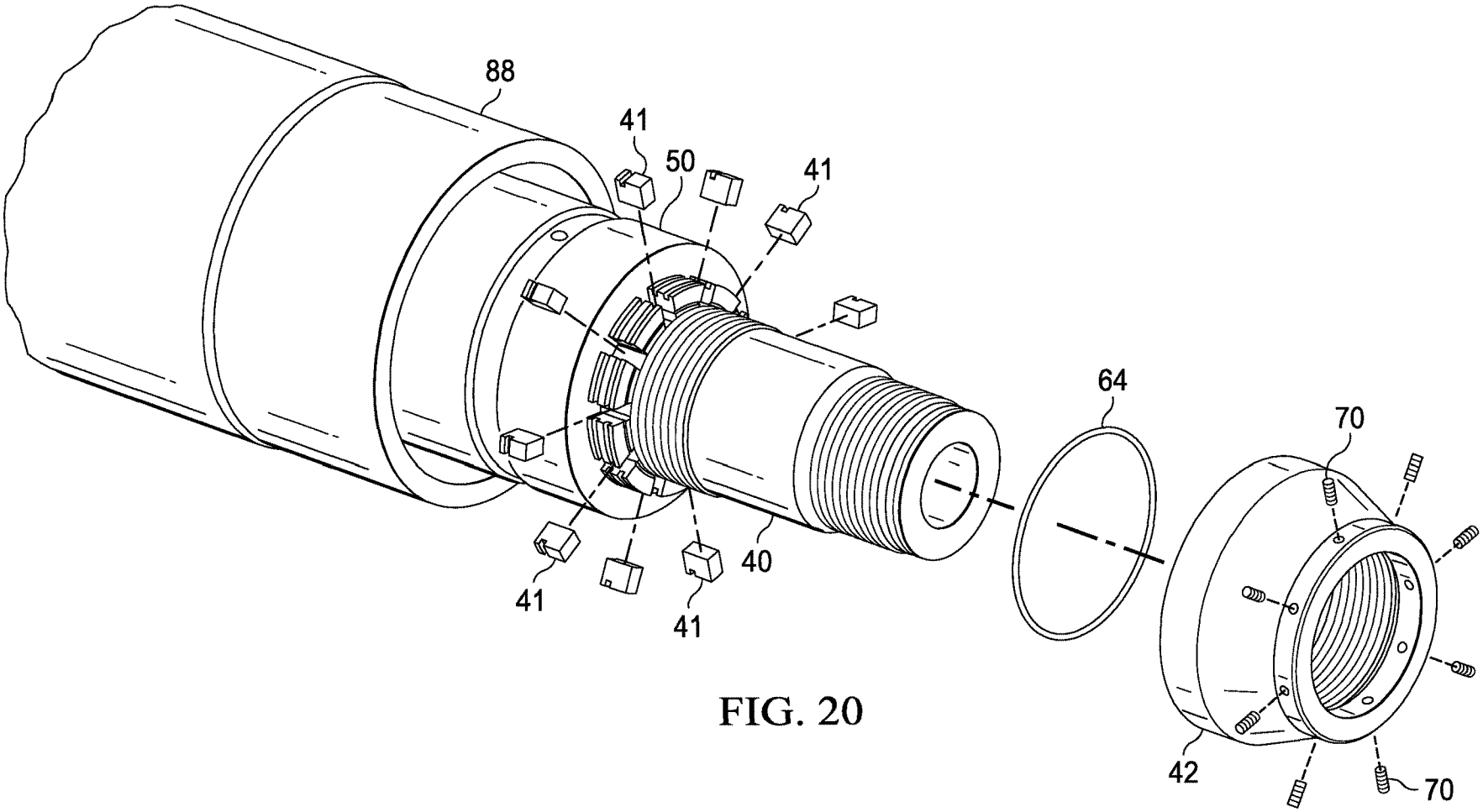
Figure 21:
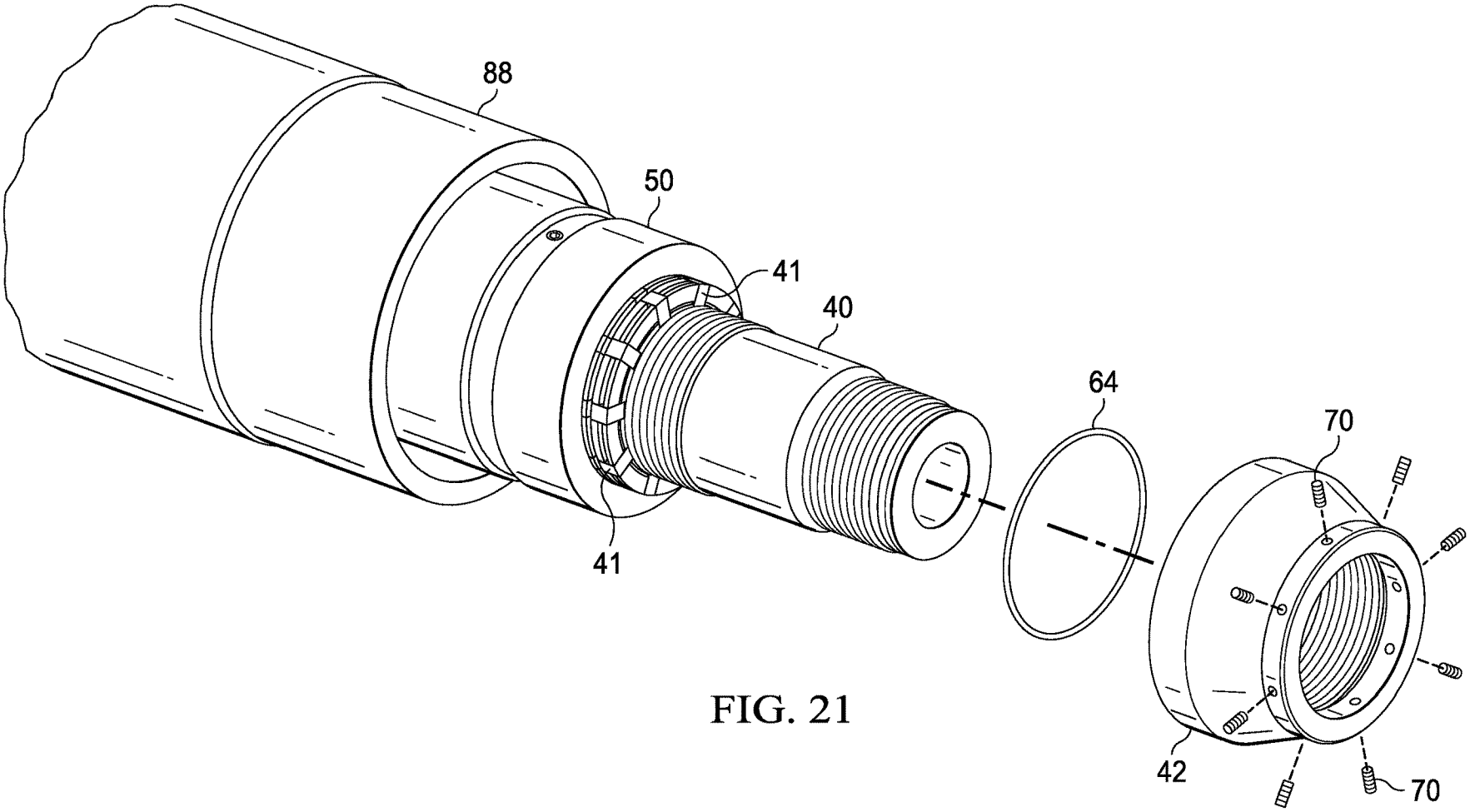
Figure 22:
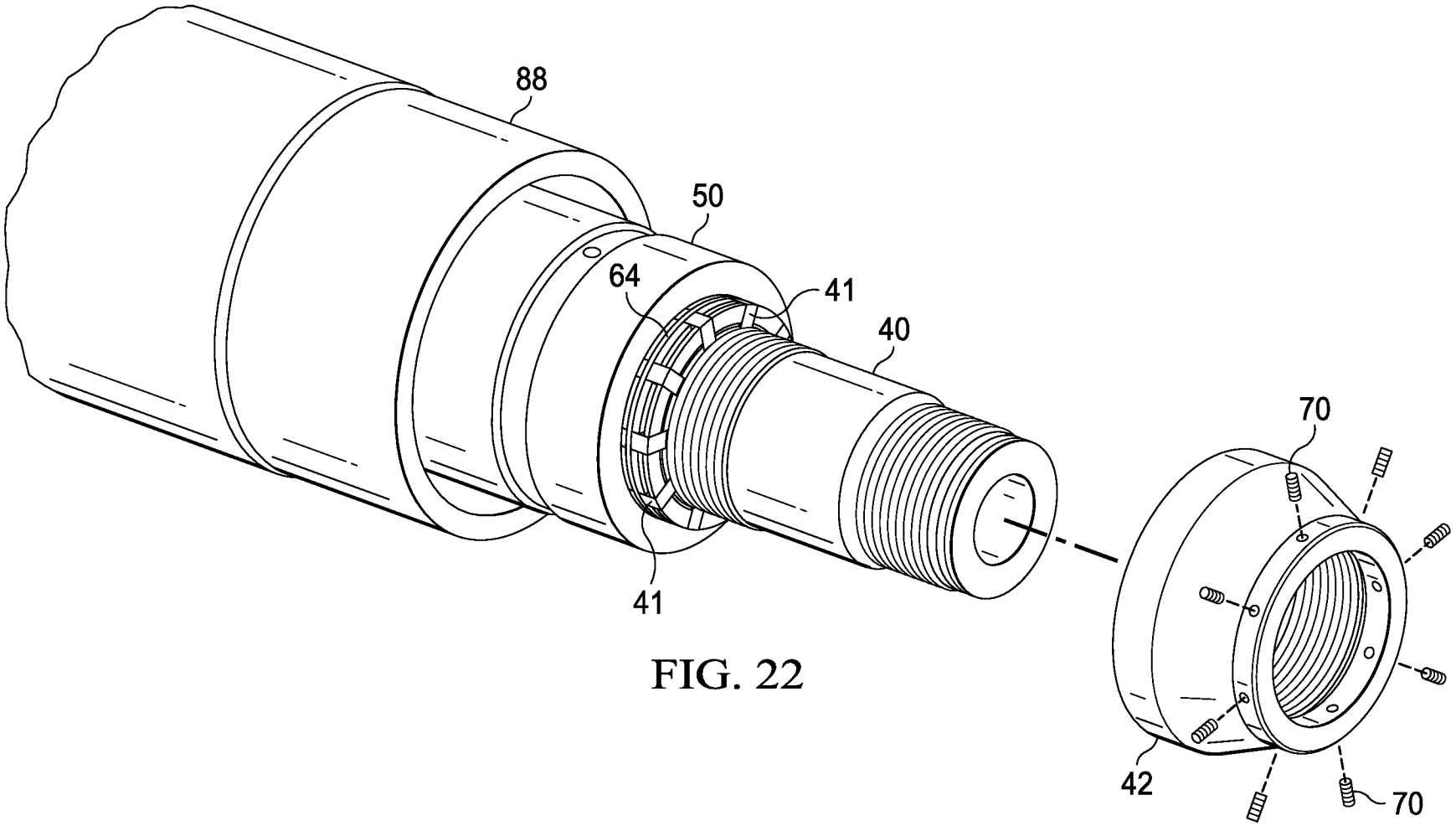

FIG. 20 illustrates the final components needed to complete installation of the liner hanger 88 to the liner hanger sub-assembly 40. First, a set of plugs 41 are inserted into the grooved castle turret features at the lower end of the collet prop mandrel 50 to torque lock it to the liner hanger sub-assembly 40 as illustrated in FIG. 21. An O-ring 64 is then installed over the set of plugs 41 to secure the plugs in place as illustrated in FIG. 22.

Figure 23:
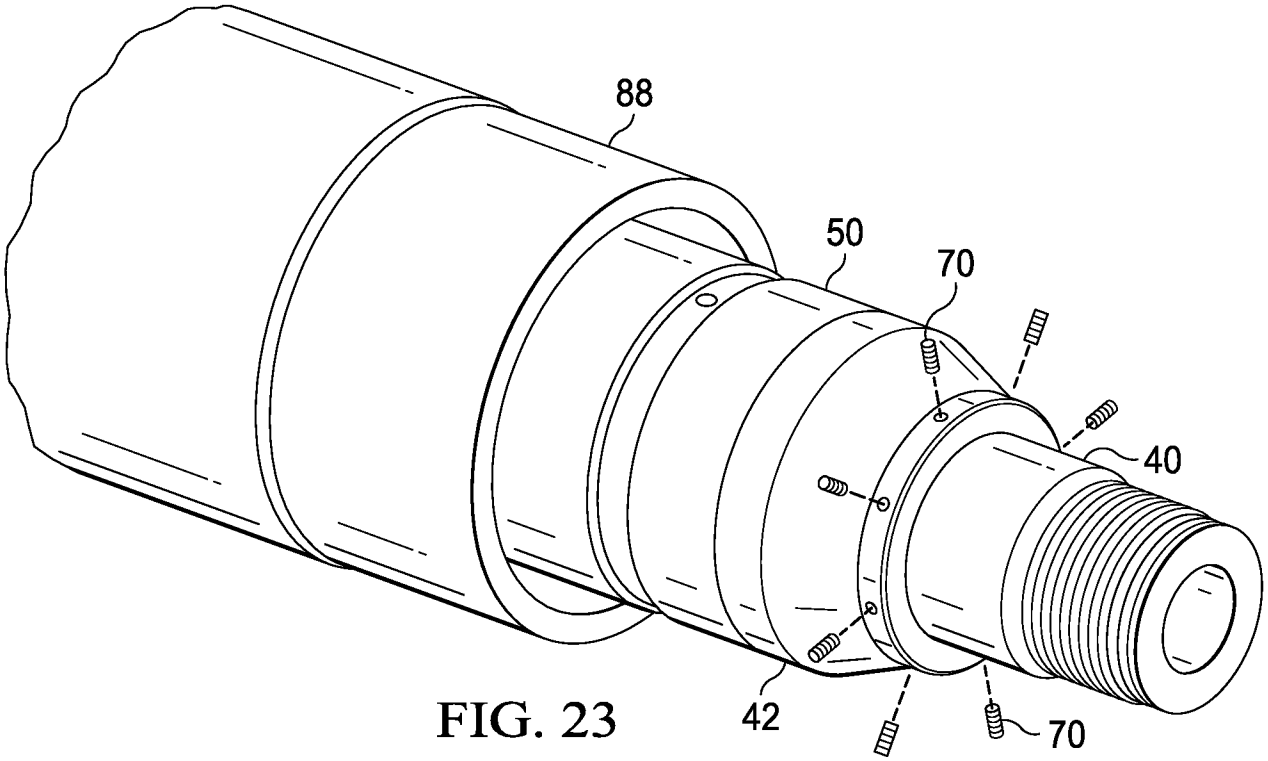
Figure 24:
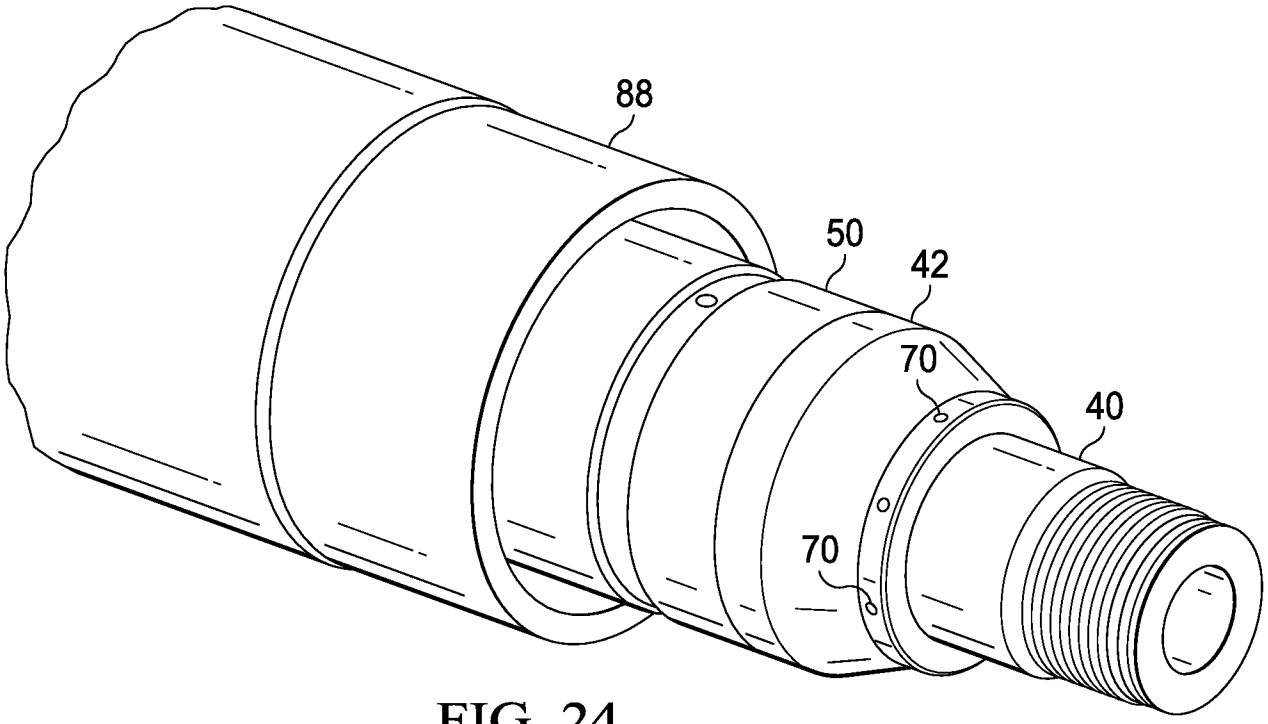

A retainer nut 42 is then threaded onto the liner hanger sub-assembly 40 to secure it to the collet prop mandrel 50 as shown in FIG. 23. Finally, a set of screws 70 are then installed into the retainer nut 42 to secure it to the liner hanger sub-assembly 40 as illustrated in FIG. 24. The liner hanger installation is complete at this point.

Figure 25:
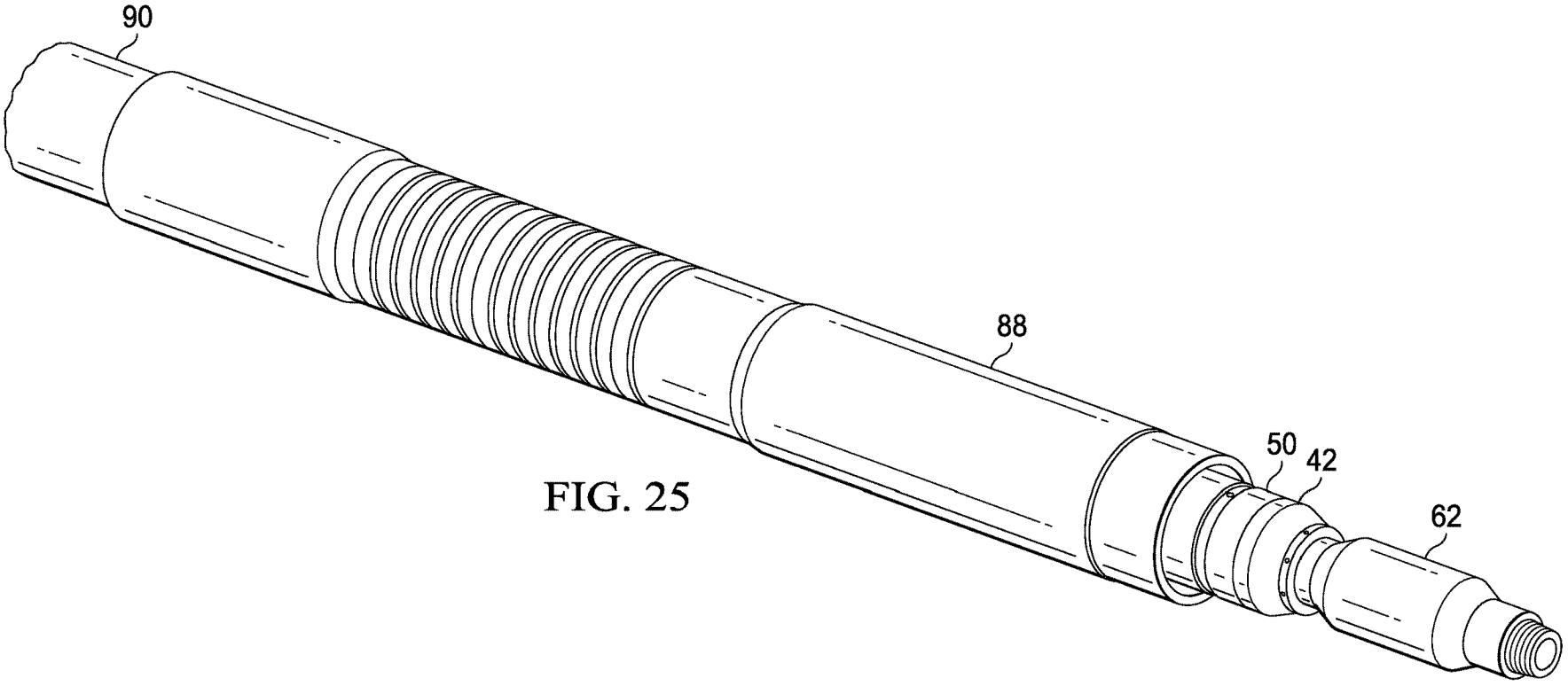
FIG. 25 is a diagram of an assembled coupler assembly according to an illustrative embodiment.
Figure 26:
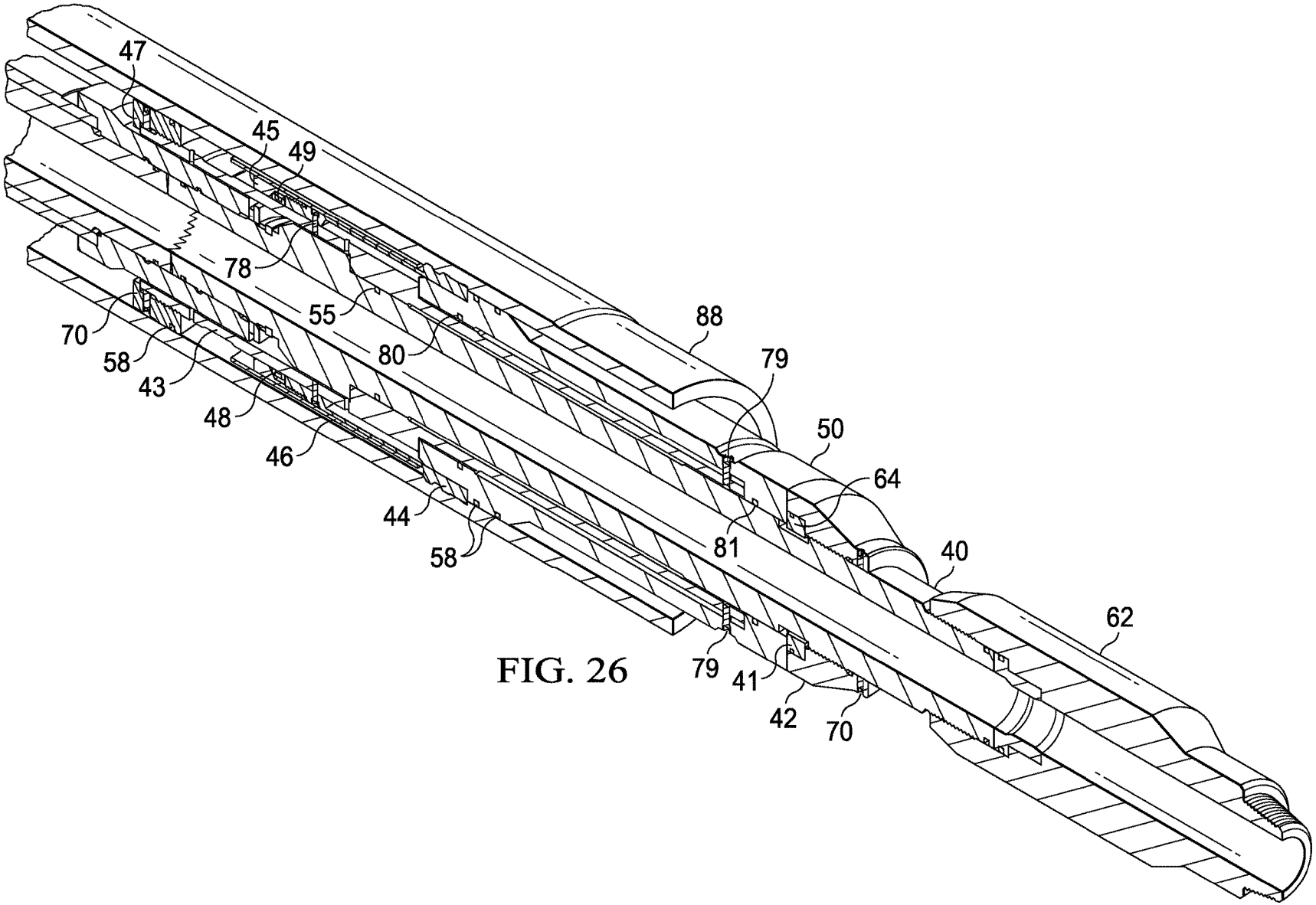
FIG. 26 illustrates a cross-sectional view of the components of the assembled coupler assembly according to an illustrative embodiment.

Additional parts 62 may be added to the end of the liner hanger sub-assembly 40 to build up the running tool 90 as illustrated in FIG. 25. A cross-sectional view of the completed liner hanger installation of FIG. 25 is illustrated in FIG. 26

Accordingly, the above disclosure describes a coupler assembly 100 that may be used for conveying a single piece liner hanger to a running tool. While the fundamental appearance of the big bore running tool changes little upon first glance, the disclosed embodiments provide several advantages over the current design. One advantage is that it maintains the "modular" design principals first incorporated into the big bore running tool by adapting existing big bore components such as the collet, load transfer sleeve, locking dogs and the upper nut for use with a single piece liner hanger. For instance, using the existing load bearing geometry of the collet is critical given the time and the amount of money spent to validate and proof test many different sized hangers. Additionally, the disclosed embodiments replace a one piece outer collet mandrel with two pieces that form a similar silhouette and accomplish the same task to prop and unprop the collet with respect to the same grooves and mill features but in the new one piece liner hanger body.

Another advantage of the disclosed embodiments is that it offers a means to easily hydro test critical sealing features that previously required expensive test fixtures. In other words, the running tool now has a built in test port for O-ring seal hydro testing, which saves design time and cost. For instance, as described above, two O-rings, instead of one, now form a seal between the collet prop mandrel and the inner diameter of the liner hanger. A pressure port located between the two O-rings communicates to a sealed annular chamber bounded by the inner collet mandrel and the outer collet mandrel sub assembly and O-rings that are placed between the components. The only access to this annular volume is via two threaded communication ports machined perpendicular into the outer diameter of the outer collet mandrel sub assembly at the bottom. These threaded access ports provide a new means to hydro test the O-ring sealing the bore of the liner hanger with the outer collet mandrel sub assembly as well as the two other O-rings that require hydro testing prior to running the tool for a job.

Moreover, the disclosed embodiments maintain a "Top Down" assembly of the running tool. For example, in accordance with the disclosed embodiments, the collet is inserted from the bottom up keeping sharp edges away from friction reducing coatings on the inner diameter of the liner hanger.

It should be apparent from the foregoing that the disclosed embodiments have significant advantages over current art. While the embodiments are shown in only a few forms, the embodiments are not limited but are susceptible to various changes and modifications without departing from the spirit thereof.

As used within the written disclosure and in the claims, the terms "including" and "comprising" are used in an open-ended fashion, and thus should be interpreted to mean "including, but not limited to". Unless otherwise indicated, as used throughout this document, "or" does not require mutual exclusivity. In addition, as used herein, the singular forms "a", "an" and "the" are intended to include the plural forms as well, unless the context clearly indicates otherwise.

Unless otherwise specified, any use of any form of the terms "connect," "engage," "couple," "attach," "communicate," or any other term describing an interaction between elements is not meant to limit the interaction to direct interaction between the elements and may also include indirect interaction between the elements described.

Further, the steps of the methods described herein may be carried out in any suitable order, or simultaneously where appropriate. Thus, the scope of the claims should not necessarily be limited by the above description, which is merely provided as examples to enable one of ordinary skill in the art to practice the appended claims.

Moreover, while the appended claims recite specific combinations of features of the disclosed embodiments, other combinations of the claims may include one or more of the following features combine in any number of combinations. In other words, it is intended that the disclosed embodiments support amendments to the appended claims or new claims that combine the various steps or features of the disclosed embodiments in any combination other than those specifically recited in the current appended claims. For example, a claimed method or coupler assembly for conveying a single piece liner hanger body may include one or more of the following clauses, or portions of the following clauses, combine in any number of combinations:

assembling an inner sub-assembly portion of a coupler assembly to form an assembled inner sub-assembly portion of the coupler assembly, wherein the inner sub-assembly portion of the coupler assembly comprises a nut, a load transfer sleeve, a locking dog retainer, a garter spring, a locking dog, a collet, and an outer collet mandrel;

inserting the assembled inner sub-assembly portion of the coupler assembly through a bottom opening of a single piece liner hanger body until it engages within an inner diameter of the single piece liner hanger body, wherein the assembled inner sub-assembly portion of the coupler assembly is inserted through the bottom opening of the single piece liner hanger body until the collet on the assembled inner sub-assembly portion of the coupler assembly engages with matching collet profile within the inner diameter of the liner hanger;

inserting a collet prop mandrel into the bottom opening of the single piece liner hanger body until it engages with the assembled inner sub-assembly portion of the coupler assembly to form the coupler assembly, wherein the collet prop mandrel is inserted into the bottom opening of the single piece liner hanger body over the outer collet mandrel and until it engages with the collet of the assembled inner sub-assembly portion of the coupler assembly to form the coupler assembly;

securing the collet prop mandrel to the outer collet mandrel of the assembled inner sub-assembly portion of the coupler assembly using a set of threaded hollow plugs; wherein the running tool having the liner hanger sub-assembly installed on the bottom of the running tool is inserted into the top opening of the single piece liner hanger body until it is completely engaged with the outer collet mandrel of the assembled inner sub-assembly portion of the coupler assembly;

inserting a running tool having a liner hanger sub-assembly installed on the bottom of the running tool into a top opening of the single piece liner hanger body until liner hanger sub-assembly engages with the coupler assembly, wherein the running tool having the liner hanger sub-assembly installed on the bottom of the running tool is inserted into the top opening of the single piece liner hanger body until it is completely engaged with the outer collet mandrel of the assembled inner sub-assembly portion of the coupler assembly;

securing the liner hanger sub-assembly to the coupler assembly, wherein securing the liner hanger sub-assembly to the coupler assembly includes securing the liner hanger sub-assembly to the collet prop mandrel using a retainer nut;

compressing an O-ring between the nut and the outer collet mandrel;

wherein the coupler assembly includes one or more of the following parts: a nut, a load transfer sleeve, a locking dog retainer, a garter spring, a locking dog, a collet, an outer collet mandrel, and a collet prop mandrel;

wherein the nut, the load transfer sleeve, the locking dog retainer, the garter spring, the locking dog, the collet, and the outer collet mandrel are assembled together to form an inner sub-assembly portion of the coupler assembly;

wherein the collet prop mandrel includes mating features for engaging the inner sub-assembly portion of the coupler assembly within the single piece liner hanger body;

wherein the coupler assembly includes mating features for engaging a liner hanger sub-assembly attached to a running tool;

wherein the coupler assembly includes a retaining nut securing the coupler assembly to the liner hanger sub-assembly;

wherein the coupler assembly includes a built in test port for O-ring seal hydro testing;

wherein assembling the inner sub-assembly portion of the coupler assembly to form the assembled inner sub-assembly portion of the coupler assembly comprises one or more of the following steps: installing the collet over the outer collet mandrel; installing the locking dog next to the collet; installing the garter spring onto the locking dog; installing the locking dog retainer to the collet, the locking dog retainer positioned over the locking dog and the garter spring; installing the load transfer sleeve to the collet, the load transfer sleeve positioned over the locking dog retainer; and installing the nut to the outer collet mandrel.

The claims of the current application are as follows:

1. A method for conveying a single piece liner hanger body, the method comprising:

assembling an inner sub-assembly portion of a coupler assembly to form an assembled inner sub-assembly portion of the coupler assembly;

inserting the assembled inner sub-assembly portion of the coupler assembly through a bottom opening of the single piece liner hanger body until the assembled inner sub-assembly portion engages within an inner diameter of the single piece liner hanger body;

inserting a collet prop mandrel into the bottom opening of the single piece liner hanger body until the collet prop mandrel engages with the assembled inner sub-assembly portion of the coupler assembly to form the coupler assembly;

inserting a running tool having a liner hanger sub-assembly installed on the bottom of the running tool into a top opening of the single piece liner hanger body until the liner hanger sub-assembly engages with the coupler assembly; and securing the liner hanger sub-assembly to the coupler assembly.

2. The method for conveying a single piece liner hanger body according to claim 1, wherein the inner sub-assembly portion of the coupler assembly comprises a nut, a load transfer sleeve, a locking dog retainer, a garter spring, a locking dog, a collet, and an outer collet mandrel.

3. The method for conveying a single piece liner hanger body according to claim 2, wherein the assembled inner sub-assembly portion of the coupler assembly is inserted through the bottom opening of the single piece liner hanger body until the collet on the assembled inner sub-assembly portion of the coupler assembly engages with matching collet profile within the inner diameter of the liner hanger.

4. The method for conveying a single piece liner hanger body according to claim 2, wherein the collet prop mandrel is inserted into the bottom opening of the single piece liner hanger body over the outer collet mandrel and until it engages with the collet of the assembled inner sub-assembly portion of the coupler assembly to form the coupler assembly.

5. The method for conveying a single piece liner hanger body according to claim 2, further comprising securing the collet prop mandrel to the outer collet mandrel of the assembled inner sub-assembly portion of the coupler assembly using a set of threaded hollow plugs.

6. The method for conveying a single piece liner hanger body according to claim 2, wherein the running tool having the liner hanger sub-assembly installed on the bottom of the running tool is inserted into the top opening of the single piece liner hanger body until it is completely engaged with the outer collet mandrel of the assembled inner sub-assembly portion of the coupler assembly.

7. The method for conveying a single piece liner hanger body according to claim 2, wherein securing the liner hanger sub-assembly to the coupler assembly includes securing the liner hanger sub-assembly to the collet prop mandrel using a retainer nut.

8. The method for conveying a single piece liner hanger body according to claim 2, wherein the coupler assembly has a built in test port for O-ring seal hydro testing.

9. The method for conveying a single piece liner hanger body according to claim 2, wherein assembling the inner sub-assembly portion of the coupler assembly to form the assembled inner sub-assembly portion of the coupler assembly comprises:

installing the collet over the outer collet mandrel;
installing the locking dog next to the collet;
installing the garter spring onto the locking dog;
installing the locking dog retainer to the collet, the locking dog retainer positioned over the locking dog and the garter spring;
installing the load transfer sleeve to the collet, the load transfer sleeve positioned over the locking dog retainer; and
installing the nut to the outer collet mandrel.

10. The method for conveying a single piece liner hanger body according to claim 9, further comprising compressing an O-ring between the nut and the single piece liner hanger body.

11. The method for conveying a single piece liner hanger body according to claim 2, wherein the inner sub-assembly portion of the coupler assembly is inserted through the bottom opening of the single piece liner hanger body until the collet on the inner sub-assembly portion of the coupler assembly engages with matching collet profile within the inner diameter of the liner hanger.

12. A coupler assembly for conveying a single piece liner hanger body to a running tool, the coupler assembly comprising:

an outer collet mandrel; a nut threaded onto the top end of the outer collet mandrel; a collet positioned over the outer collet mandrel; a locking dog positioned next to the upper end of the collet; a garter spring installed on the locking dog; a locking dog retainer threaded to the collet over the locking dog and garter spring; and a load transfer sleeve installed over the locking dog retainer and the collet.

13. The coupler assembly for conveying a single piece liner hanger body to a running tool according to claim 12, wherein the nut, the load transfer sleeve, the locking dog retainer, the garter spring, the locking dog, the collet, and the outer collet mandrel are assembled together to form an inner sub-assembly portion of the coupler assembly.

14. The coupler assembly for conveying a single piece liner hanger body to a running tool according to claim 13, wherein the inner sub-assembly portion of the coupler assembly is inserted into a bottom end of the single piece liner hanger body.

15. The coupler assembly for conveying a single piece liner hanger body to a running tool according to claim 14, wherein the coupler assembly further comprises a collet prop mandrel, the collet prop mandrel having mating features for engaging the inner sub-assembly portion of the coupler assembly within the single piece liner hanger body.

16. The coupler assembly for conveying a single piece liner hanger body to a running tool according to claim 15, further comprising second mating features for engaging a liner hanger sub-assembly attached to the running tool.

17. The coupler assembly for conveying a single piece liner hanger body to a running tool according to claim 16, further comprising a retaining nut securing the coupler assembly to the liner hanger sub-assembly.

18. The coupler assembly for conveying a single piece liner hanger body to a running tool according to claim 17, further comprising a built in test port for O-ring seal hydro testing.

19. A method for conveying a single piece liner hanger body, the method comprising:

inserting an inner sub-assembly portion of a coupler assembly through a bottom opening of the single piece liner hanger body until the inner sub-assembly portion engages within an inner diameter of the single piece liner hanger body;
inserting a collet prop mandrel into the bottom opening of the single piece liner hanger body until the collet prop mandrel engages with the inner sub-assembly portion of the coupler assembly to form the coupler assembly; and
inserting a running tool having a liner hanger sub-assembly installed on the bottom of the running tool into a top opening of the single piece liner hanger body until the liner hanger sub-assembly engages with the coupler assembly.

20. The method for conveying a single piece liner hanger body according to claim 19, wherein the inner sub-assembly portion of the coupler assembly comprises a nut, a load transfer sleeve, a locking dog retainer, a garter spring, a locking dog, a collet, and an outer collet mandrel.

* * * * *